US012736253B2

(12) United States Patent
Park et al.

(10) Patent No.: US 12,736,253 B2
(45) Date of Patent: Sep. 15, 2026

(54) VENTILATION APPARATUS

(71) Applicant: LG ELECTRONICS INC., Seoul (KR)

(72) Inventors: Janghee Park, Seoul (KR); Yongki Jeong, Seoul (KR); Jinwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 106 days.

(21) Appl. No.: 18/825,354

(22) Filed: Sep. 5, 2024

(65) Prior Publication Data

US 2025/0383123 A1 Dec. 18, 2025

(30) Foreign Application Priority Data

Jun. 12, 2024 (KR) ..... 10-2024-0076594

(51) Int. Cl.

| | |
|---|---|
| ***F24F 13/30*** | (2006.01) |
| ***F24F 7/08*** | (2006.01) |
| ***F24F 13/28*** | (2006.01) |
| *F24F 13/20* | (2006.01) |

(52) U.S. Cl.

CPC ..... *F24F 13/30* (2013.01); *F24F 7/08* (2013.01); *F24F 13/28* (2013.01); *F24F 2013/205* (2013.01)

(58) Field of Classification Search

CPC .... F24F 13/28; F24F 13/30; F24F 7/08; F24F 2013/205; F24F 12/001; F24F 12/006; F24F 2012/007

See application file for complete search history.

(56) References Cited

U.S. PATENT DOCUMENTS

| | | | | |
|---|---|---|---|---|
| 8,899,309 | B2 * | 12/2014 | Yamaguchi | F24F 12/006 165/145 |
| 2012/0196523 | A1 * | 8/2012 | Jiang | F28D 9/0037 454/237 |
| 2025/0164139 | A1 * | 5/2025 | Kim | F24F 11/65 |

FOREIGN PATENT DOCUMENTS

| | | | |
|---|---|---|---|
| EP | 3 708 921 | A1 | 9/2020 |
| KR | 10-0640799 | B1 | 11/2006 |
| KR | 10-1279997 | B1 | 7/2013 |
| KR | 10-1638065 | B1 | 7/2016 |
| KR | 10-2300344 | B1 | 9/2021 |
| KR | 10-2021-0118493 | A | 10/2021 |
| KR | 10-2022-0045405 | A | 4/2022 |

(Continued)

*Primary Examiner* — Travis Ruby

(74) *Attorney, Agent, or Firm* — Birch, Stewart, Kolasch & Birch, LLP

(57) ABSTRACT

A ventilation apparatus may include a housing with an indoor air inlet and an outdoor air outlet spaced apart from each other on one side, and an outdoor air inlet and an indoor air outlet spaced apart from each other on an opposite side. The outdoor air inlet is opposite the indoor air inlet and the indoor air outlet is opposite the outdoor air outlet. The apparatus may further include a case in the housing, an intake fan inside the case connected to the outdoor air outlet, an exhaust fan inside the case connected to the indoor air outlet, and an enthalpy heat exchanger located inside the case at intersecting flow passages connecting the indoor air inlet with the indoor air outlet and the outdoor air inlet with the outdoor air outlet. The case may include an intake side bypass passage and an exhaust side bypass passage.

19 Claims, 26 Drawing Sheets

(56) References Cited

FOREIGN PATENT DOCUMENTS

| | | | |
|---|---|---|---|
| KR | 10-2024-0042971 | A | 4/2024 |
| WO | WO 2023/090594 | A1 | 5/2023 |

* cited by examiner

VENTILATION APPARATUS

CROSS-REFERENCE TO RELATED APPLICATIONS

The present application claims the benefits of priority to Korean Patent Application No. 10-2024-0076594, filed on Jun. 12, 2024, of which its incorporated herein by reference in its entirety.

THE BACKGROUND

1. The Field

The present invention relates to ventilation apparatus.

2. Description of the Related Art

A ventilation apparatus is a device for discharging indoor air to the outside and supplying fresh outdoor air to the indoor, and its main component is a total heat exchange element that allows only heat exchange without mixing between the discharged indoor air and the incoming outdoor air.

The ventilation apparatus may be installed in houses, including apartments, or commercial buildings. In particular, in the case of an apartment, there may be a blueprint in which two households with a symmetrical structure face each other or are arranged side by side. In this case, it is necessary to ensure that the same ventilation apparatus is installed in both symmetrical households.

However, some ventilation apparatuses currently on the market, including the ventilation apparatuses disclosed in the prior art below, have an asymmetric internal structure. A ventilation apparatus with an asymmetrical internal structure has the limitation that it cannot be installed in one of two households with a symmetrical structure. To solve this problem, conventionally, a separate kit that converts the flows of indoor air and outdoor air is installed in the ventilation apparatus.

In addition, recently, as disclosed in the prior art below, ventilation apparatuses have been released that are provided with a bypass passage inside that allows indoor air to be bypassed and discharged directly to the outdoors without passing through the total heat exchange element.

However, since the ventilation apparatus disclosed in the prior art below has an asymmetrical internal structure, there is a limitation that it cannot be installed in one of two apartments with a symmetrical structure.

Prior art: Korean Patent Publication No. 10-2022-0045405 (2022 Apr. 12)

THE SUMMARY

The present invention is proposed to improve the above problems.

A ventilation apparatus according to an embodiment of the present invention to achieve the above object comprises: a housing, including: an indoor air inlet and an outdoor air outlet which are formed to be spaced apart from each other on one side; and an outdoor air inlet and an indoor air outlet which are formed to be spaced apart from each other on the other side corresponding to an opposite side of the one side, wherein the outdoor air inlet is formed at a position opposite to the indoor air inlet and the indoor air outlet is formed at a position opposite to the outdoor air outlet; a case accommodated in the housing; an intake fan mounted inside the case and having an outlet connected to the outdoor air outlet; an exhaust fan mounted inside the case and having an outlet connected to the indoor air outlet; and a total heat exchange element mounted inside the case and placed at a point where a flow passage connecting the indoor air inlet and the indoor air outlet and a flow passage connecting the outdoor air inlet and the outdoor air outlet intersect, wherein an intake side bypass passage that guides outdoor air flowing into the outdoor air inlet to a space where the intake fan is located, and an exhaust side bypass passage that guides indoor air flowing into the indoor air inlet to a space where the exhaust fan is located, by bypassing the total heat exchange element are respectively formed on the case, and wherein the intake side bypass passage and the exhaust side bypass passage are configured to intersect at a predetermined point between the indoor air outlet and the outdoor air outlet.

The case includes: an intake guide hole formed at an edge adjacent to the outdoor air outlet and communicating with the space where the intake fan is placed; an exhaust guide hole formed at an edge adjacent to the indoor air outlet and communicating with the space where the exhaust fan is placed, wherein an outlet of the intake side bypass passage communicates with the intake guide hole, and wherein an outlet of the exhaust side bypass passage communicates with the exhaust guide hole.

The predetermined point is a point where a dividing surface bisecting the case passes between the intake guide hole and the exhaust guide hole.

An inlet of the intake side bypass passage is formed at a point spaced apart from the exhaust guide hole in a direction approaching the outdoor air inlet, and an inlet of the exhaust side bypass passage is formed at a point spaced apart from the intake guide hole in a direction approaching the indoor air inlet.

The intake side bypass passage includes: a first portion extending from the inlet of the intake side bypass passage towards the exhaust guide hole and bent to extend along an edge of the exhaust guide hole; and a second part bent at an end of the first part to communicate with the intake guide hole, and wherein the exhaust side bypass passage includes: a third portion extending from the inlet of the exhaust side bypass passage towards the intake guide hole and bent to extend along an edge of the intake guide hole; and a fourth part bent at an end of the second part to communicate with the exhaust guide hole.

The second part intersects the fourth part while passing above or below the fourth part, and the dividing surface passes a point where the second portion and the fourth portion intersect.

The ventilation apparatus according to the present invention further comprises: an intake side bypass damper module placed on the inlet of the intake side bypass passage; and an exhaust side bypass damper module placed on the inlet of the exhaust side bypass passage.

The ventilation apparatus according to the present invention further comprises: an intake side bypass filter unit placed between the inlet of the intake side bypass passage and the intake side bypass damper module; and an exhaust side bypass filter unit placed between the inlet of the exhaust side bypass passage and the exhaust side bypass damper module.

The ventilation apparatus according to the present invention further comprises: an intake side pre-filter installed at the outdoor air inlet; and an exhaust side pre-filter installed at the indoor air inlet.

The total heat exchange element includes four side surfaces facing the four corners of the housing, respectively, the four side surfaces include: a first side surface facing the outdoor air inlet; a second side surface facing the outdoor air outlet and being an opposite side of the first side surface; a third side surface facing the indoor air inlet; and a fourth side surface facing the indoor air outlet and being opposite side of the third side surface, and the dividing surface is configured to pass through an edge where the first side surface and the third side surface meet and an edge where the second side surface and the fourth side surface meet.

The ventilation apparatus according to the present invention further comprises: an intake side HEPA filter disposed adjacent to the second side surface; and an exhaust side HEPA filter disposed adjacent to the fourth side surface.

The ventilation apparatus according to the present invention further comprises: an intake side main damper module disposed at a flow passage connecting the outdoor air inlet and the first side surface; and an exhaust side main damper module disposed at a flow passage connecting the indoor air inlet and the third side surface.

The case includes: a bypass guide in which the intake and exhaust side bypass passages, the intake guide hole and the exhaust guide hole are formed, the bypass guide having a central partition wall that extends from an inner edge through which the dividing surface passes, to support a first corner of the total heat exchange element; an intake side central wall supporting at least one side surface of the intake side main damper module and a second corner of the total heat exchange element; an intake side main damper support wall supporting the other side of the intake side main damper module; a total heat exchange element support wall supporting a third corner of the total heat exchange element; an exhaust side central wall supporting at least one side surface of the exhaust side main damper module and a fourth corner of the total heat exchange element; and an exhaust side main damper support wall supporting the other side of the exhaust side main damper module.

The bypass guide include: a first portion in which the intake guide hole and the exhaust guide hole are formed at an outer edge, and having a square shape; a pair of second parts each extending from both side ends of an inner edge of the first part; a central partition wall extending from a center of the inner edge of the first portion to support one corner of the total heat exchange element; a separation wall protruding from a center of a lower surface of the first part and extending from an outer edge of the first part to the central partition wall, and wherein the first and second parts are spaced apart from an upper surface of the housing by the separation wall and the central partition wall, and the space where the intake fan is located and the space where the exhaust fan is located are partitioned.

The intake side bypass passage extends from an end of one of the pair of second parts towards the exhaust guide hole, then is bent to extend towards the center of the first part, wherein the exhaust side bypass passage extends from an end of the other of the pair of second parts towards the intake guide hole and then is bent to extend towards the center of the first part, wherein the intake side bypass passage and the exhaust side bypass passage intersect each other at a point between the intake guide hole and the exhaust guide hole, and wherein an end of the intake side bypass passage is connected to the intake guide hole, and an end of the exhaust side bypass passage is connected to the exhaust guide hole.

Each of the intake side bypass filter unit or the exhaust side bypass filter unit includes: a filter case in the form of a hexahedron; and a filter and a blocking block which are formed as one body and are detachably inserted into an inside of the filter case, wherein the filter case includes an upper surface, a lower surface, and four side surfaces, wherein a filter insertion hole is formed in one of the upper and lower surfaces, wherein an inlet and an outlet are formed on two opposing side surfaces among the four side surfaces, respectively, wherein the inlet is divided into an upper inlet and a lower inlet by a partition rib, wherein the filter is placed in either an upper space or a lower space of a surface passing through the partition rib, and wherein the blocking block is placed on the other of the upper space and the lower space of the surface passing through the partition rib.

Each of the intake side bypass filter unit or the exhaust side bypass filter unit includes: a filter case in the form of a hexahedron; and a filter detachably inserted into the filter case, wherein the filter case includes an upper surface, a lower surface, and four side surfaces, wherein a filter insertion hole is formed on one of the upper and lower surfaces, wherein an inlet and an outlet are formed on two opposing side surfaces among the four side surfaces, respectively, and wherein the inlet is divided into an upper inlet and a lower inlet by a partition rib.

The intake side bypass damper module includes: an intake side upper bypass damper module disposed above the partition rib; and an intake side lower bypass damper module disposed below the partition rib, wherein the exhaust side bypass damper module include: an exhaust side upper bypass damper module disposed above the partition rib; and an exhaust side lower bypass damper module disposed below the partition rib.

Each of the bypass damper modules includes: first and second dampers placed in parallel to each other; a drive motor that provides power to rotate the first and second dampers; and an opening/closing link that connects the driving motor and rotation shafts of the first and second dampers, respectively, to rotate the first and second dampers in directions symmetrical to each other, thereby opening or closing the inlet of the bypass passage.

The opening/closing link includes: a first link extending from the rotation shaft of the first damper; a second link extending from the rotation shaft of the second damper; a connection link connecting the first link and the second link; a driving link extending from the rotation shaft of the second damper; and a transmission link connecting the drive motor and the driving link, wherein the driving link extends at a point axially spaced apart from the second link, and wherein the first link and the second link extend in opposite directions.

According to the ventilation apparatus according to an embodiment of the present invention, there is an advantage that the ventilation apparatus can be installed in both households designed symmetrically In addition, since the intake side bypass passage and the exhaust side bypass passage are formed in a symmetrical structure, not only can indoor air be discharged directly to the outdoors without passing through the total heat exchange element, but also outdoor air can be supplied to the indoors without passing through the total heat exchange element. As a result, in situations where the temperature difference between indoors and outdoors is large, outdoor air can be supplied directly indoors without heat exchange, which has the advantage of quickly raising or lowering the indoor temperature depending on the season.

THE DETAILED DESCRIPTION

Hereinafter, a ventilation apparatus according to an embodiment of the present invention will be described in detail with reference to the drawings.

Figure 1:
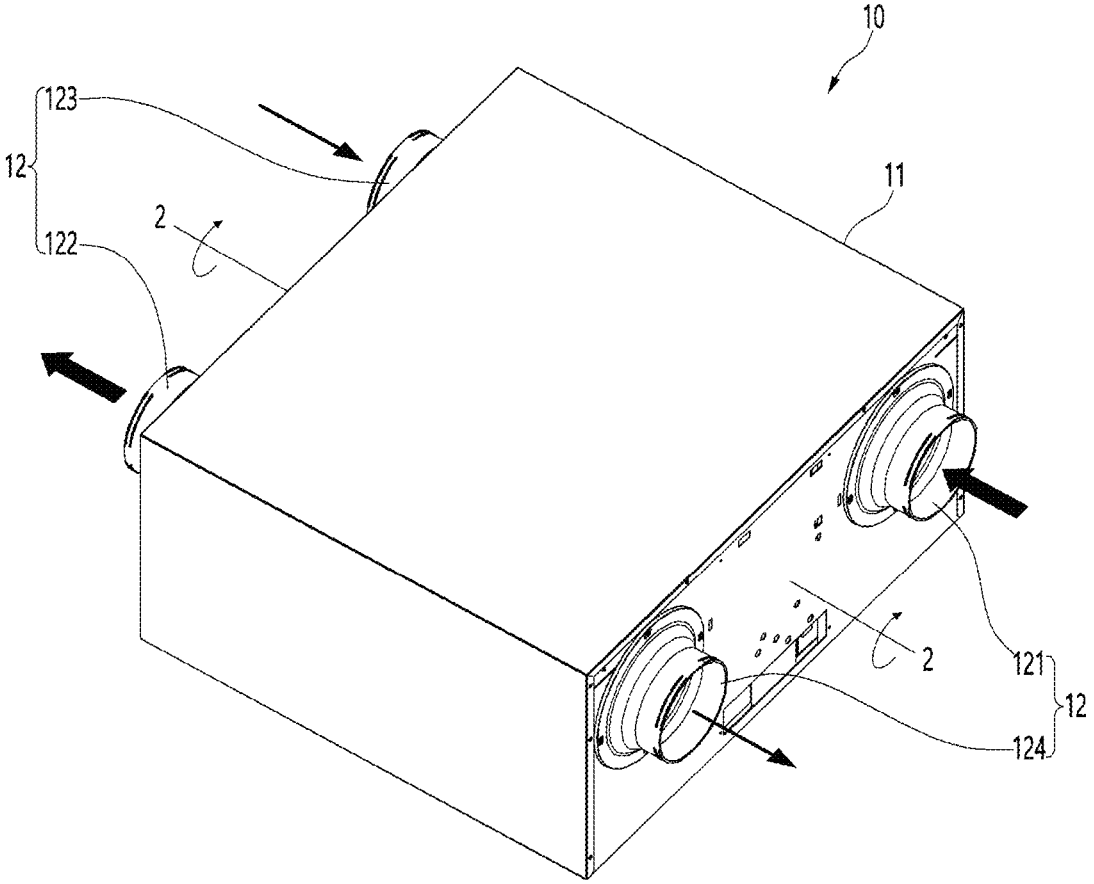
FIG. 1 is a plan perspective view of a ventilation apparatus according to an embodiment of the present invention.
Figure 2:
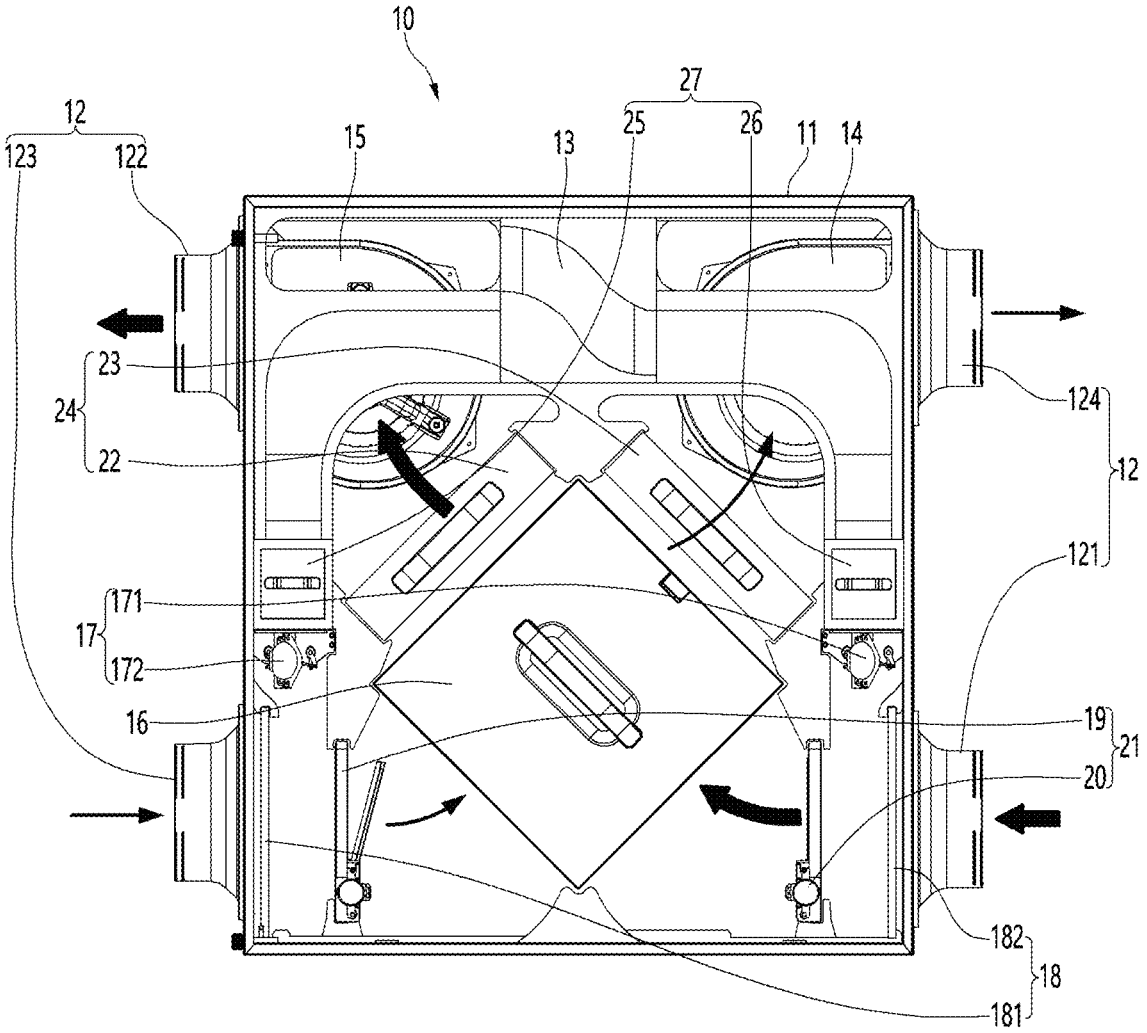
FIG. 2 is a bottom perspective view of the ventilation apparatus rotated along 2-2 in FIG. 1.
Figure 3:
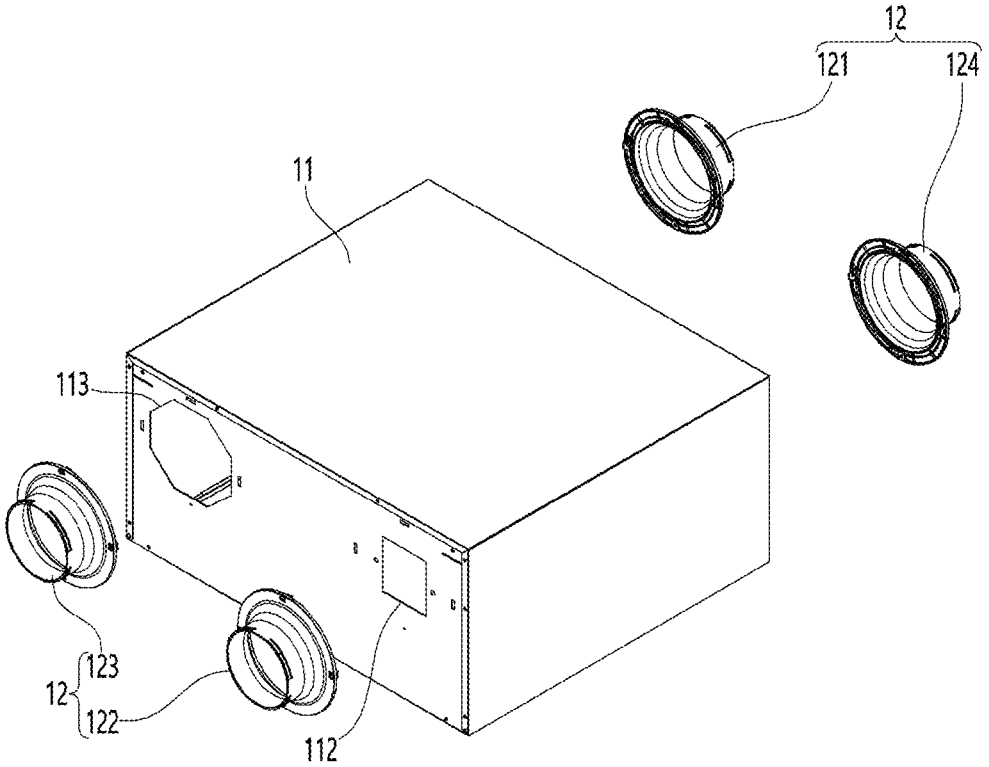
FIGS. 3 and 4 are exploded perspective views showing the coupling relationship between the housing and flanges forming the ventilation apparatus.
Figure 4:
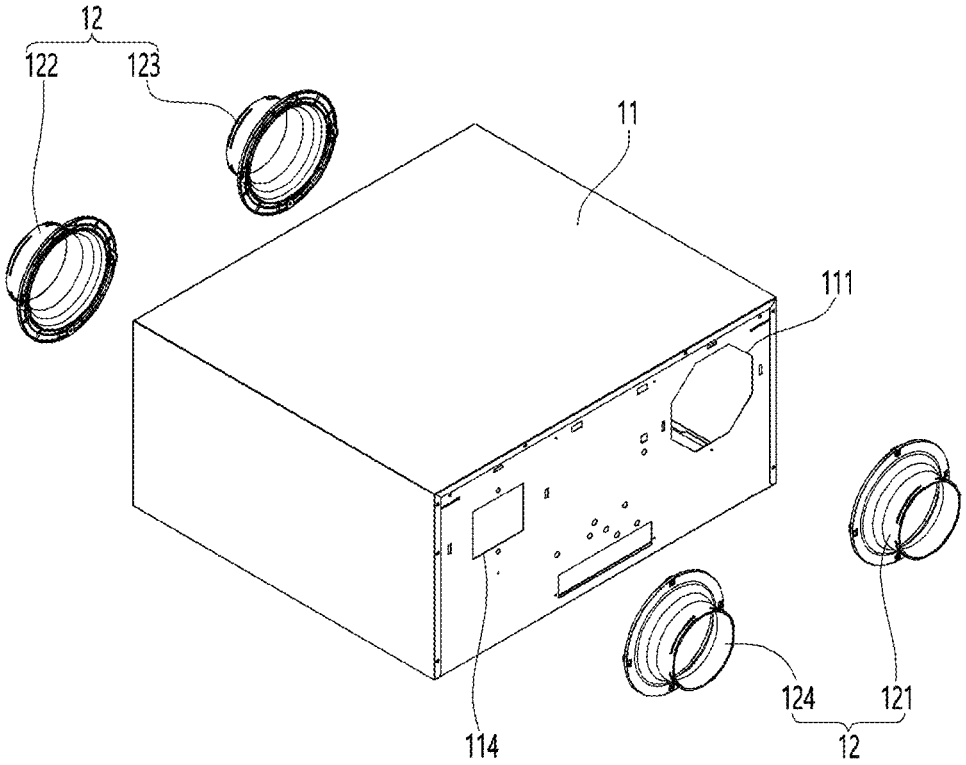
Figure 5:
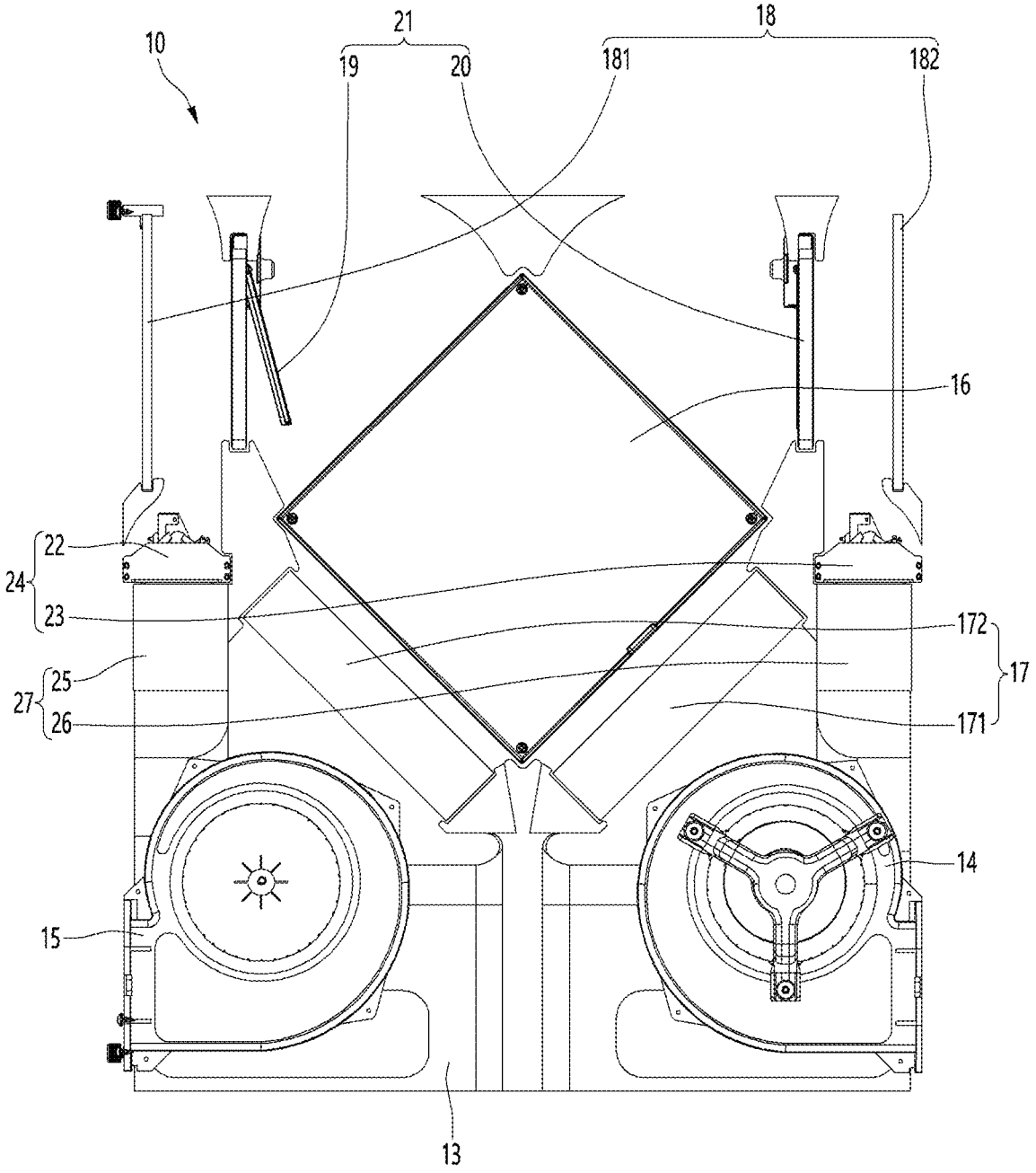
FIG. 5 is a plan view of the ventilation apparatus with the housing and flange removed.
Figure 6:
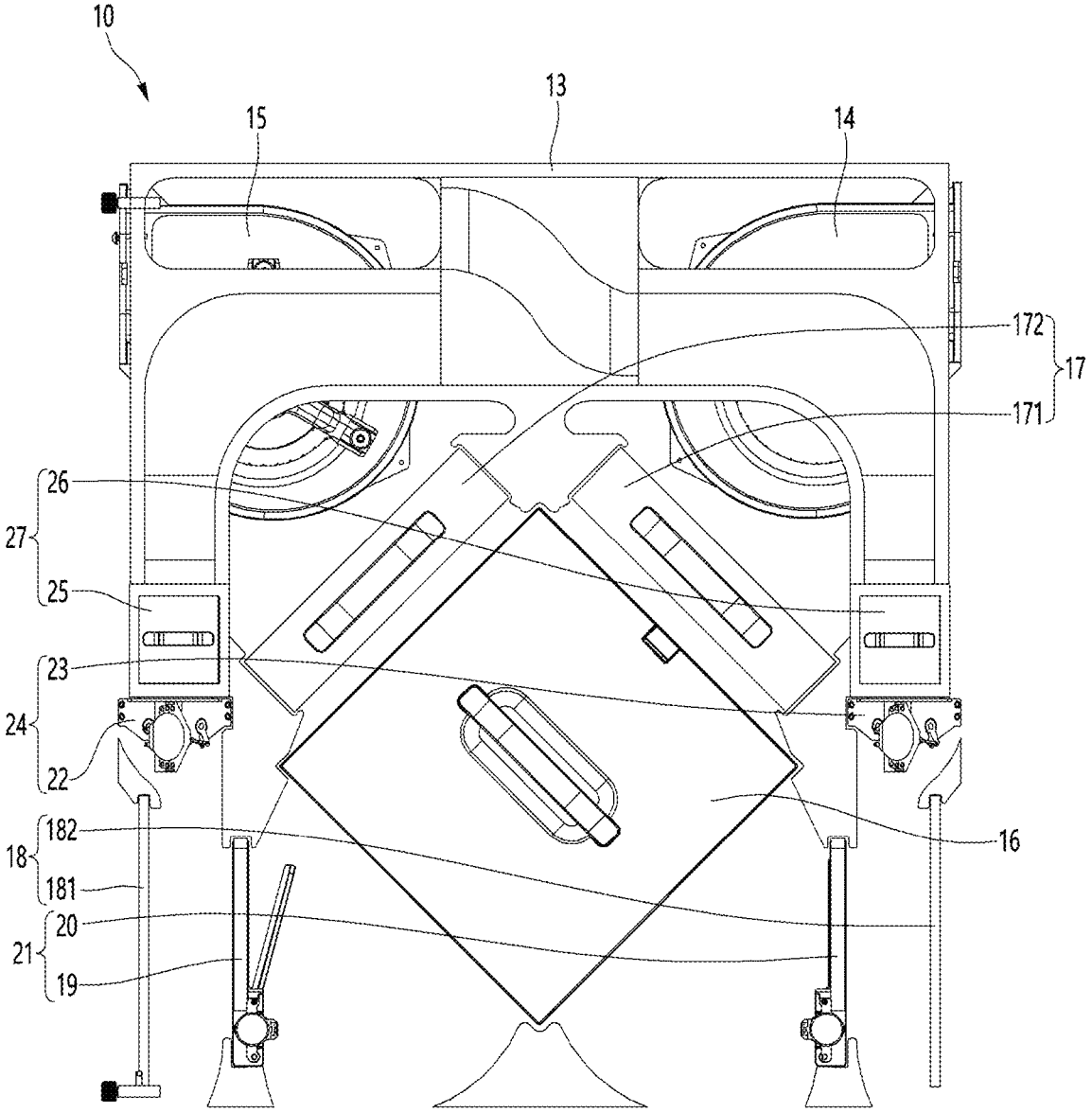
FIG. 6 is a bottom view of the ventilation apparatus with the housing and flange removed.

FIG. 1 is a plan perspective view of a ventilation apparatus according to an embodiment of the present invention, FIG. 2 is a bottom perspective view of the ventilation apparatus rotated along 2-2 of FIG. 1, FIGS. 3 and 4 are a housing forming the ventilation apparatus and It is an exploded perspective view showing the coupling relationship between flanges, FIG. 5 is a plan view of the ventilation apparatus with the housing and flange removed, and FIG. 6 is a bottom view of the ventilation apparatus with the housing and flange removed.

Referring to FIGS. 1 to 6, the ventilation apparatus 10 according to an embodiment of the present invention includes a housing 11 forming an external appearance, a flange 12 coupled to both sides of the housing 11, a plurality of ventilation components accommodated therein. In the drawings, for convenience of explanation, the bottom of the ventilation apparatus 10 is shown to be open, but the housing 11 closes the bottom of the ventilation apparatus 10 and the bottom of the housing 11 shielding the bottom of the ventilation apparatus 10 may be a cover that can be rotated by a hinge.

In detail, an indoor air inlet 111 and an outdoor air outlet 114 are formed on one of the left and right side surfaces of the housing 11, and an outdoor air inlet 113 and an indoor air outlet 112 are formed on the other of the left and right side surfaces of the housing 11.

In addition, the flange 12 includes an indoor air inlet flange 121 coupled to the indoor air inlet 111, an outdoor air outlet flange 124 coupled to the outdoor air outlet, an outdoor air inlet flange 113 coupled to the outdoor air inlet 113, and indoor air outlet flange 122 coupled to the indoor air outlet 112.

The plurality of ventilation components include a case 13 provided inside the housing 11, a total heat exchange element 16 (enthalpy heat exchanger) disposed in the center of the case 13, and an intake fan 14 and an exhaust fan 15 seated on the inner upper surface of the case 13, a HEPA filter 17 disposed on the side surface of the total heat exchange element 16, and a pre-filter 18 disposed at each of the indoor air inlet 111 and the outdoor air inlet 113, a main damper module 21 disposed on each side of the indoor air inlet 111 and the outdoor air inlet 113, a bypass damper module 24 disposed on a side of the pre-filter 18, and a bypass filter unit 27 disposed on the outlet side of the bypass damper module 24.

In detail, the total heat exchange element 16 is disposed in the inner center of the case 13, in such a manner that the side surfaces of the heat exchange element 16 and the side surfaces of the case 13 intersect each other.

Additionally, the intake fan 14 is disposed inside the case 13, and the outlet of the intake fan 14 is coupled to the outdoor air outlet 114. In addition, the exhaust fan 15 is disposed inside the cage 13, and the outlet of the exhaust fan 15 is coupled to the indoor air outlet 112. Additionally, the intake fan 14 and the exhaust fan 15 are arranged to be symmetrical with respect to the line that bisects the case 13. The line that passes between the intake fan 14 and the exhaust fan 15 and bisects the case 13 is designed to pass through two opposing corners of the heat exchange element 16. Therefore, when the ventilation apparatus 10 is installed in one of the two households designed with a symmetrical structure, the intake fan 14 sucks in outdoor air and supplies it indoors, and the exhaust fan 15 sucks in indoor air and discharges it outdoors. On the other hand, when the ventilation apparatus 10 is installed in the other one of the two households designed with a symmetrical structure, the intake fan 14 functions as an exhaust fan and the exhaust fan 15 functions as an intake fan.

Meanwhile, the pre-filter 18 includes an intake side pre-filter 181 mounted on the outdoor air inlet 113 and an exhaust side pre-filter 182 mounted on the indoor air inlet 111.

The outdoor air that has passed through the intake side pre-filter 181 flows into the first side surface of the total heat exchange element 16, passes through the second side surface facing the first side surface, and guided into a space where the intake fan 14 is installed. And, the outdoor air sucked in by the intake fan 14 is supplied indoors through the outdoor air outlet 114.

The indoor air that has passed through the exhaust side pre-filter 182 flows into the third side surface of the total heat exchange element 16, passes through the fourth side surface facing the third side surface, and then guided into a space where the exhaust fan 15 is installed. And, the indoor air sucked in by the exhaust fan 15 is discharged outdoors through the indoor air outlet 112.

Here, the first side surface and the third side surface of the total heat exchange element 16 share one corner, and the second side surface and the fourth side surface of the total heat exchange element 16 share another corner. And, the one corner is defined as a corner facing the other corner.

In addition, the pre-filter 7 includes an intake side HEPA filter 171 placed on the second side surface of the total heat exchange element 16, and an exhaust side HEPA filter 172 placed on the fourth side surface of the total heat exchange element 16.

Meanwhile, the main damper module 21 includes an intake side main damper module 19 and an exhaust side main damper module 20. The intake side main damper module 19 is placed on the outdoor air supply passage connecting the outdoor air inlet 113 and the first side surface of the total heat exchange element 16. And, the exhaust side main damper module 19 is placed on the air exhaust flow passage connecting the indoor air inlet 111 and the third side surface of the total heat exchange element 16.

Additionally, the bypass damper module 24 includes an intake side bypass damper module 22 and an exhaust side bypass damper module 23. The intake side bypass damper module 22 is disposed on the side portion of the outdoor air inlet 113, and the exhaust side bypass module 23 is placed on the side portion of the indoor air inlet 111.

A separated space is formed between the outdoor air inlet 113 and the intake side main damper module 19, one side surface of the separated space is shielded by the side surface of the case 13 or the side surface of the housing 11, and the intake side bypass damper module 22 is disposed on the other side surface of the separated space.

In addition, a separated space is also formed between the indoor air inlet 111 and the exhaust side main damper module 20, and one side surface of the separated space is shielded by the side surface of the case 13 or the side surface of the housing 11, and the exhaust side bypass damper module 23 is disposed on the other side surface of the separated space.

The bypass filter unit 27 includes an intake side bypass filter unit 25 and an exhaust side bypass filter unit 26. The intake side bypass filter unit 25 is disposed adjacent to the intake side bypass damper module 22, and the exhaust side bypass filter unit 26 is disposed adjacent to the exhaust side bypass damper module 23.

Therefore, the outdoor air that has passed through the intake side bypass damper module 22 is purified while passing through the intake side bypass filter unit 25 and then supplied indoors, and the indoor air that has passed through the exhaust side bypass damper module 23 is purified while passing through the exhaust side bypass filter unit 26 and then discharged outdoors. In addition, the outdoor air and indoor air passing through the bypass filter units 25 and 26, respectively, are directly supplied indoors or discharged outdoors without passing through the total heat exchange element 16.

Figure 7:
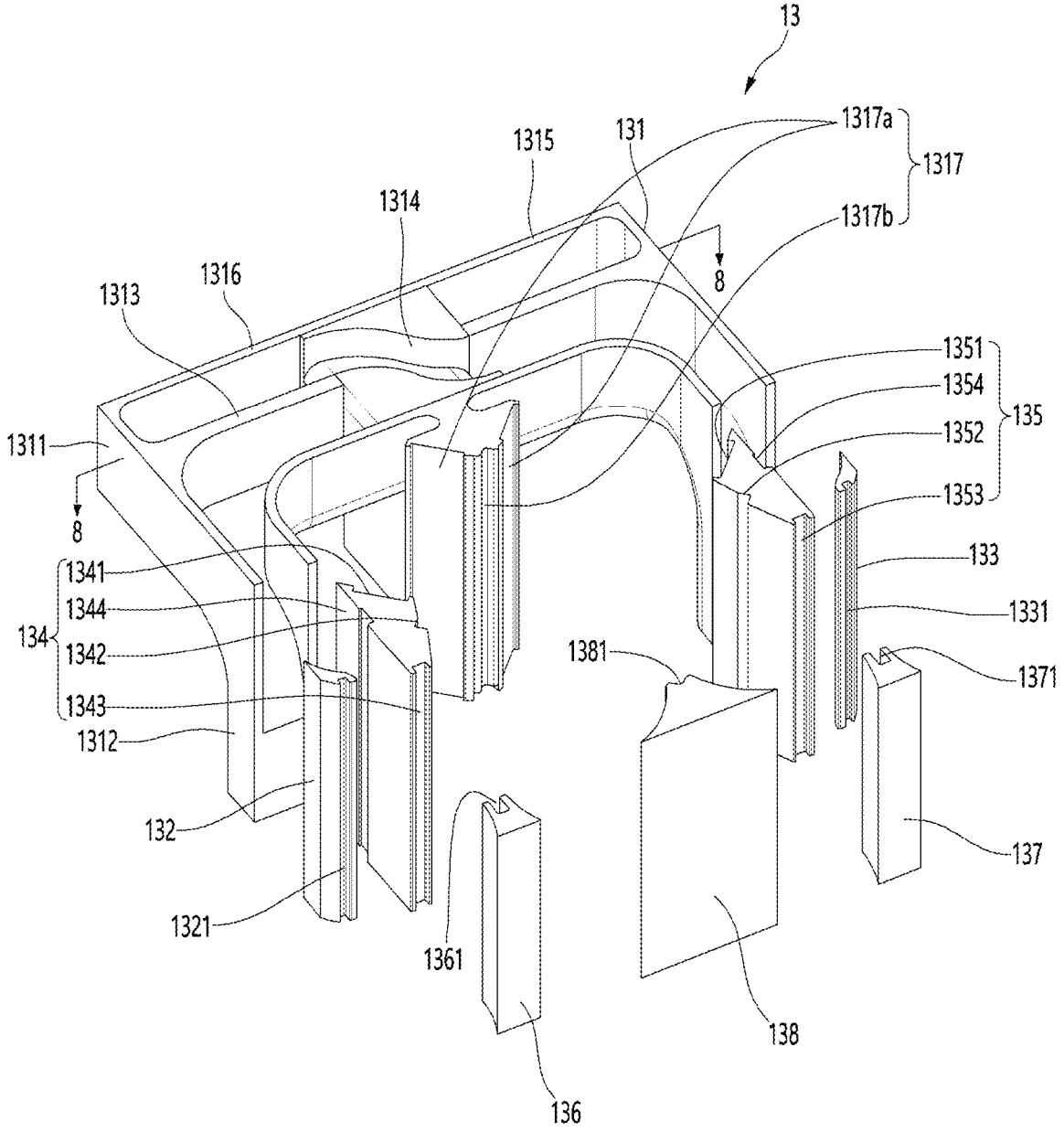
FIG. 7 is a bottom perspective view of a case constituting a ventilation apparatus according to an embodiment of the present invention.
Figure 8:
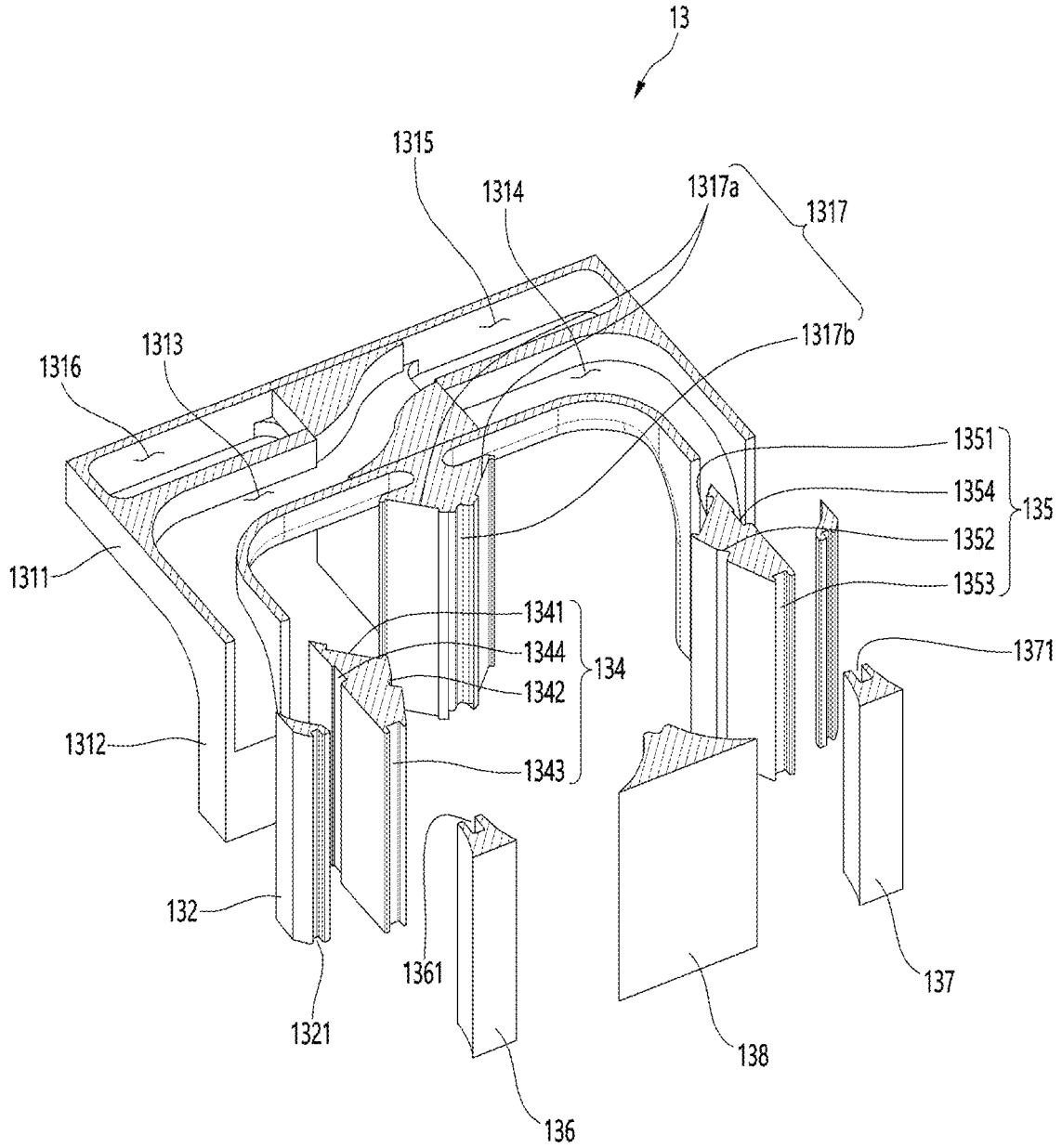
FIG. 8 is a cross-sectional perspective view of the case cut along line 8-8 in FIG. 7.

FIG. 7 is a bottom perspective view of a case constituting a ventilation apparatus according to an embodiment of the present invention, and FIG. 8 is a cross-sectional perspective view of the case cut along 8-8 in FIG. 7.

Referring to FIGS. 7 and 8, the case 13 constituting the ventilation apparatus 10 according to an embodiment of the present invention includes a bypass guide 131, an intake side pre-filter support wall 132, and an exhaust side pre-filter support wall 133, an intake side center wall 134, an exhaust side center wall 135, an intake side main damper support wall 136, an exhaust side main damper support wall 137, and a heat exchange element support wall 138. And, although these components are shown as separate from each other in the drawing, they can be designed as a single piece.

The top surface of the case 13 shown in the drawing is a surface selectively shielded by a cover rotatably coupled to the bottom surface of the housing 11. That is, in the drawing, the part shielded by the cover is recognized as the top surface, but when the ventilation apparatus 10 is installed on the ceiling, it is corresponding to the bottom surface of the case 13.

In detail, the bypass guide 131 includes a horizontal portion 1311, a pair of vertical portions 1312 bent at both edges of the horizontal portion 1311, and a central partition wall 1317 extending from an edge of the center portion of the horizontal portion 1311 in a direction perpendicular to the horizontal portion 1311. The indoor air and outdoor air flowing into the ventilation apparatus 10 are not mixed by the central partition wall 1317 and are guided to the intake fan 14 and the exhaust fan 15, respectively.

In detail, the bypass guide 131 is formed with an intake side bypass passage 1313, an exhaust side bypass passage 1314, an intake guide hole 1315, and an exhaust guide hole 1316.

The intake side bypass passage 1313 starts from the vertical portion 1311 formed at one edge of the bypass guide 131 and extends along the horizontal portion 1311 towards the other edge of the bypass guide 131. The exhaust side bypass passage 1314 starts from the vertical portion 1311 formed at the other edge of the bypass guide 131 and extends along the horizontal portion 1311, towards one edge of the bypass guide 131.

The intake guide hole 1315 is formed on the other edge of the bypass guide 131, and the exhaust guide hole 1316 is formed on one edge of the bypass guide 131. That is, the intake guide hole 1315 and the exhaust guide hole 1316 are formed to be symmetrical to each other about a line that bisects the bypass guide 131 while passing through the central partition wall 1317.

Accordingly, the intake side bypass passage 1313 is connected to the intake guide hole 1315, and the exhaust side bypass passage 1314 is connected to the exhaust guide hole 1316. And, in the central portion of the bypass guide 131, the intake side bypass passage 1313 and the exhaust side bypass passage 1314 intersect in the vertical direction.

For example, the intake side bypass passage 1313 and the exhaust side bypass passage 1314 intersect in an X shape at the center of the bypass guide 131, and one of the intake side bypass passage 1313 and the exhaust side bypass passages 1314 may be formed above the other of the intake side bypass passage 1313 and the exhaust side bypass passages 1314.

In this way, the intake side bypass passage 1313 and the exhaust side bypass passage 1314 are provided in shapes that are symmetrical to each other, so that the single-shaped ventilation apparatus 10 can be easily installed in two households that are designed symmetrically. This eliminates the need for a separate flow passage conversion kit.

Meanwhile, the central partition wall 1317 protruding from the center of the bypass guide 131, like the vertical portion 1312, is formed to have a length that contacts the upper and lower surfaces of the housing 11. And, the central partition wall 1317 has a substantially triangular cross-sectional shape. Additionally, a HEPA filter mounting grooves 1317*a* are formed on one edge and the other edge of the central partition wall 1317, and a heat exchange element mounting groove 1317*b* is formed on a corner where the one edge meets the other edge.

More specifically, it can be explained that the central partition wall 1317 forms an isosceles triangular cross section, HEPA filter mounting grooves 1317*a* are formed on two sides of the same length, and the heat exchange element mounting groove 1317*b* is mounted at a corner where two sides of the same length meet.

The intake side pre-filter support wall 132 and the exhaust side pre-filter support wall 133 are formed on both sides of the case 13, respectively, and are formed at positions facing each other. In addition, mounting grooves 1321 and 1331 are formed at one edges of the intake side pre-filter support wall 132 and the exhaust side pre-filter support wall 133, respectively, and one edge of the intake side pre-filter 181 and one edge of the exhaust side pre-filter 182 are inserted in the mounting grooves 1321 and 1331. The other edges of the intake side pre-filter 181 and the exhaust side pre-filter 182 may be supported by being inserted into grooves (not shown) formed on the inner side surfaces of the housing 11.

The intake side central wall 134 is disposed at a point spaced apart from the intake side pre-filter support wall 132 towards the center of the case 13. A HEPA filter mounting groove 1341 is formed on one side of the intake side central wall 134 into which one edge of the intake side HEPA filter 172 is inserted, and the HEPA filter mounting groove 1341 faces the HEPA filter mounting groove (1317*a*) of the central partition wall 1317. A total heat exchange element mounting groove 1342 is formed in the center of the inner surface of the intake side central wall 134, and a main damper mounting groove 1343 is formed in the other edge of the intake side central wall 134. Also, a bypass damper mounting groove 1344 is formed on the outer surface of the intake side central wall 134.

The exhaust side central wall 135 is disposed opposite the intake side central wall 134, and the exhaust side central wall 135 is disposed at a point spaced apart from the exhaust side pre-filter support wall 133 towards the center of the case 12. The exhaust side central wall 135 has a shape symmetrical to the intake side central wall 134. That is, a HEPA filter mounting groove 1351 is formed on one side of the exhaust side central wall 135, and the HEPA filter mounting groove 1351 faces the HEPA filter mounting groove 1317*b* of the central partition wall 1317. A heat exchange element mounting groove 1352 is formed in the center of the inner surface of the exhaust side central wall 135, and a main damper mounting groove 1353 is formed in the other edge of the exhaust side central wall 134. Also, a bypass damper mounting groove 1354 is formed on the outer surface of the exhaust side central wall 135.

A main damper mounting groove 1361 is formed on one edge of the intake side main damper support wall 136, and the other edge is in close contact with the side surface of the housing 11. The main damper mounting groove 1361 faces the main damper mounting groove 1345 of the intake side central wall 134. Accordingly, both side ends of the intake side main damper module 19 are supported by being inserted into the main damper mounting grooves 1343 and 1361.

The exhaust side main damper support wall 137 is disposed opposite the intake side main damper support wall 136 and has a symmetrical shape. In addition, a main damper mounting groove 1371 is formed on one edge of the exhaust side main damper support wall 137, and the other edge is in close contact with the side surface of the housing 11. The main damper mounting groove 1371 faces the main damper mounting groove 1352 of the exhaust side central wall 135. Accordingly, both side ends of the exhaust side main damper module 20 are supported by being inserted into the main damper mounting grooves 1353 and 1371.

The total heat exchange element support wall 138 is installed between the intake side main damper support wall 136 and the exhaust side main damper support wall 137. Additionally, a heat exchange element mounting groove 1381 is formed in the inner center of the heat exchange element support wall 138.

According to this structure, the four corners of the hexahedral-shaped heat exchange element are supported by being inserted into the heat exchange element mounting grooves 1317*b*, 1342, 1381, and 1352, respectively.

In addition, depending on whether the intake side main damper module 19 and the intake side bypass damper module 22 are opened or closed, the outdoor air flowing in through the outdoor air inlet 113 is guided to one of or both the total heat exchange element 16 and the intake side bypass passages 1313. In addition, depending on whether the exhaust side main damper module 20 and the exhaust side bypass damper module 23 are opened or closed, the indoor air flowing in through the indoor air inlet 111 is guided to one or both the total heat exchange element 16 and the exhaust side bypass passages 1314.

Figure 9:
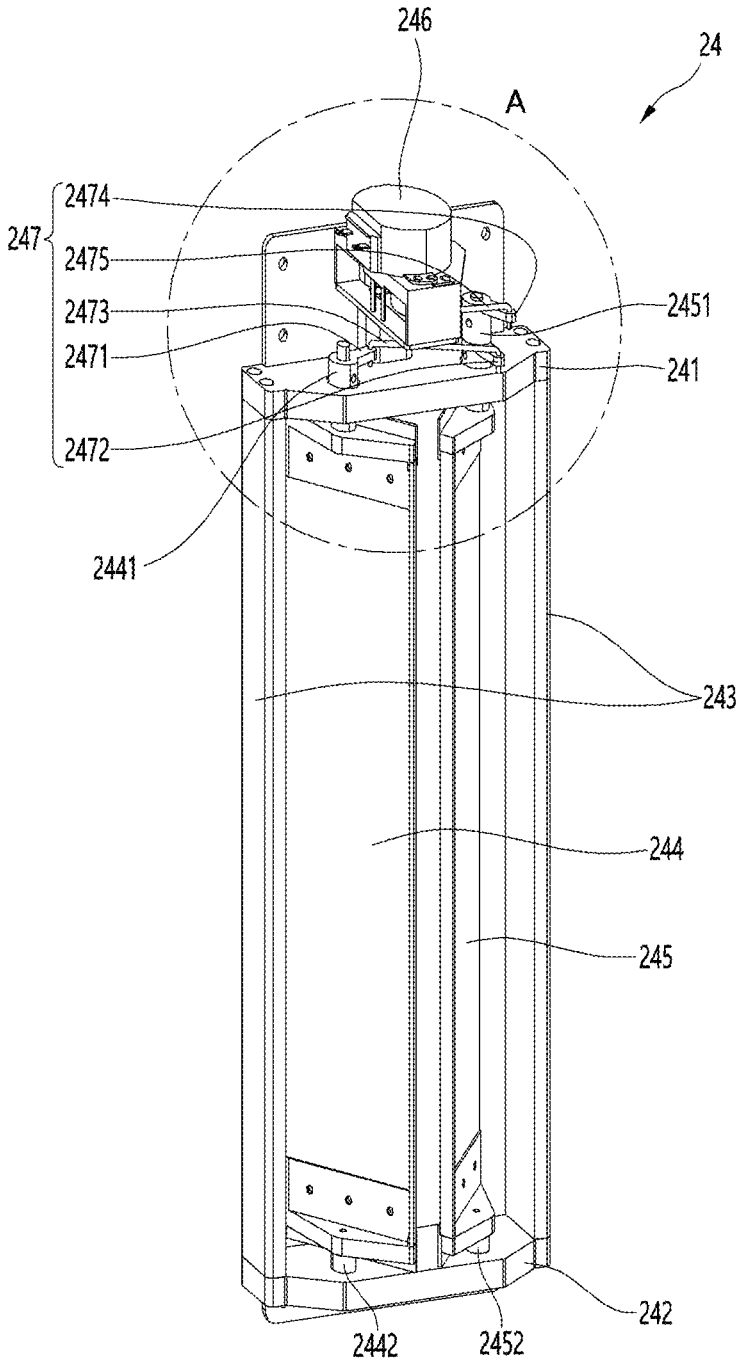
FIG. 9 is a perspective view of a bypass damper module constituting a ventilation apparatus according to an embodiment of the present invention.
Figure 10:
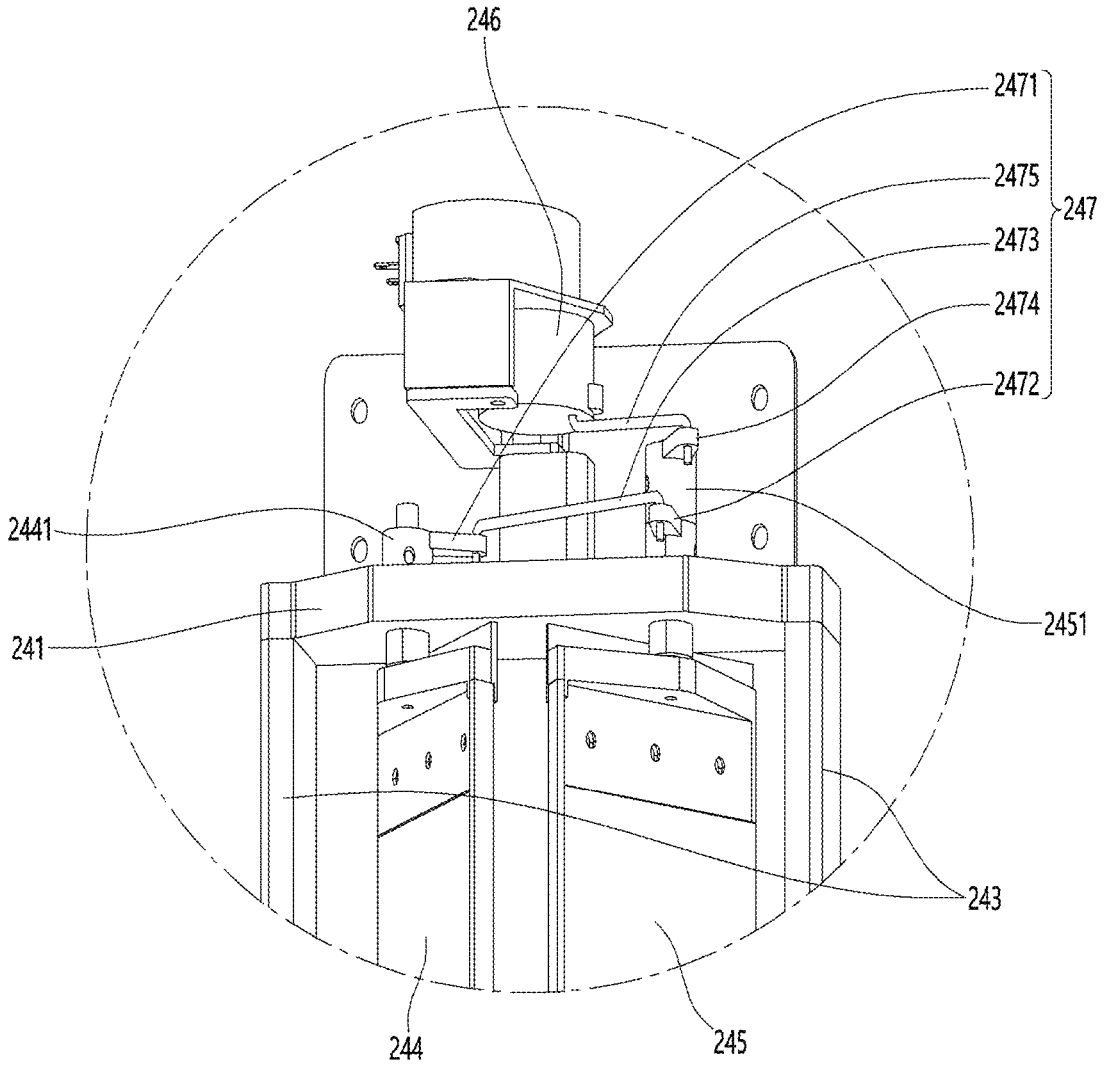
FIG. 10 is an enlarged view of portion A of FIG. 9.

FIG. 9 is a perspective view of a bypass damper module constituting a ventilation apparatus according to an embodiment of the present invention, and FIG. 10 is an enlarged view of portion A of FIG. 9.

Referring to FIGS. 9 and 10, the bypass damper module 24 includes an upper bracket 241, a lower bracket 242, and a pair of supports connecting the upper bracket 241 and the lower bracket 242. (243), a first damper 244 and a second damper 245 mounted between the pair of supports 243, and a drive motor 246 and an opening/closing link 247 that drive the first and second dampers 244 and 245.

In detail, the drive motor 246 and the opening/closing link 247 are mounted on the upper surface of the upper bracket 241. In addition, the first rotation shaft 2441, which is the rotation center of the first damper 244, and the second rotation shaft 2451, which is the rotation center of the second damper 245, pass through the upper bracket 241. The first and second rotation shafts 2441 and 2451 are rotation shafts extending from the upper surfaces of the first and second dampers 244 and 245. Additionally, the rotation shafts 2442 and 2452 extending from the bottom surfaces of the first and second dampers 244 and 245 pass through the lower bracket 242.

The opening/closing link 247 includes a first link 2471, a second link 2472, a connecting link 2473, a driving link 2474, and a transmission gear 2475.

In detail, a reduction gear module is provided inside the drive motor 246, and the rotational force of the drive motor 246 is transmitted to the reduction gear module to reduce speed. Then, the reduced rotational force is transmitted to the transmission gear 2475 connected to the rotation shaft of the reduction gear module.

The second link 2471 extends on the outer peripheral surface of the first rotation shaft 2441, and the second link 2472 and the driving link 2474 extend on the outer peripheral surface of the second rotation shaft 2451. The driving link 2474 extends at a point spaced upward from the second link 2472, and may extend at a point spaced apart from the second link 2472 at a predetermined angle in the circumferential direction of the second rotation shaft 2451.

The connection link 2473 is a link connecting the first link 2471 and the second link 2472, and the transmission link 2475 is connected to the driving link 2474. The first link 2471 and the second link 2472 extend in opposite directions, and the connecting link 2473 connects the ends of the first and second links 2471 and 2472.

By this connection structure, when a drive signal is input to the drive motor 246, the decelerated rotational force of the drive motor 246 is transmitted to the transmission link 2475 to rotate the transmission link 2475. The rotational force of the transmission link 2475 is transmitted to the driving link 2474 to rotate the second rotation shaft 2451.

As the second rotation shaft 2451 rotates, the second damper 245 rotates, and at the same time, the second link 2472 rotates. When the second link 2472 rotates, the first link 2471 and the first rotation shaft 2441 rotate by the connecting link 2473. And, as the first rotation shaft 2441 rotates, the first damper 244 rotates together.

At this time, since the first link 2471 and the second link 2472 extend in opposite directions, if the first link 2471 and the second link 2472 extend in the first or second direction, one side end of the first damper 244 and one side end of the second damper 245 rotate in a direction that they approach each other (first direction) or in a direction that they move away from each other (second direction).

In detail, when the first and second dampers 244 and 245 rotate in the first direction and the side ends of the first and second dampers 244 and 245 meet, the inlets of the bypass passages 1313 and 1314 are closed. On the other hand, when the first and second dampers 244 and 245 rotate in the second direction and become parallel to each other, the inlets of the bypass passages 1313 and 1314 are opened to the maximum.

Here, the meaning that the first link 2471 and the second link 2472 extend in opposite directions should be interpreted to include not only that the extension lines of the two links extend completely parallel, but also that the extension lines intersect or cross each other.

Figure 11:
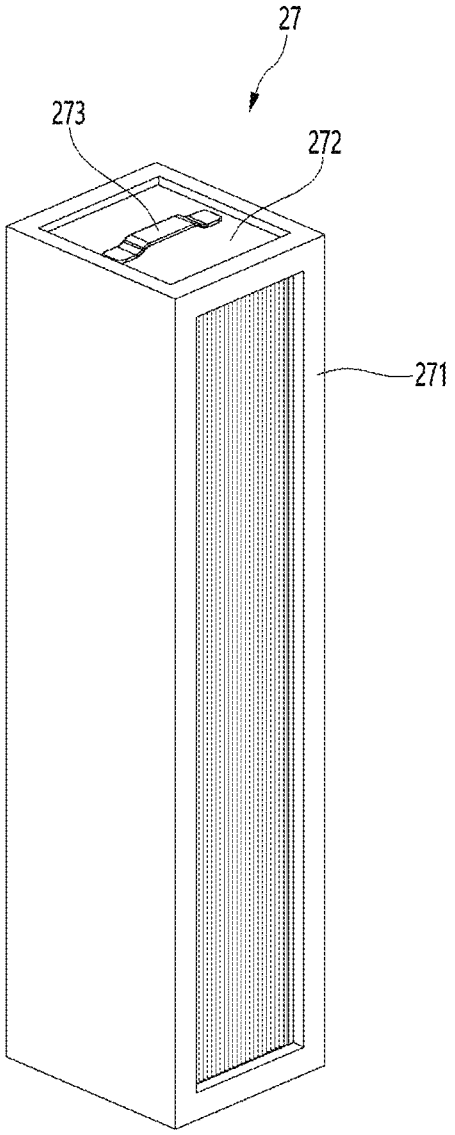
FIG. 11 is a perspective view of a bypass filter unit constituting a ventilation apparatus according to an embodiment of the present invention.
Figure 12:
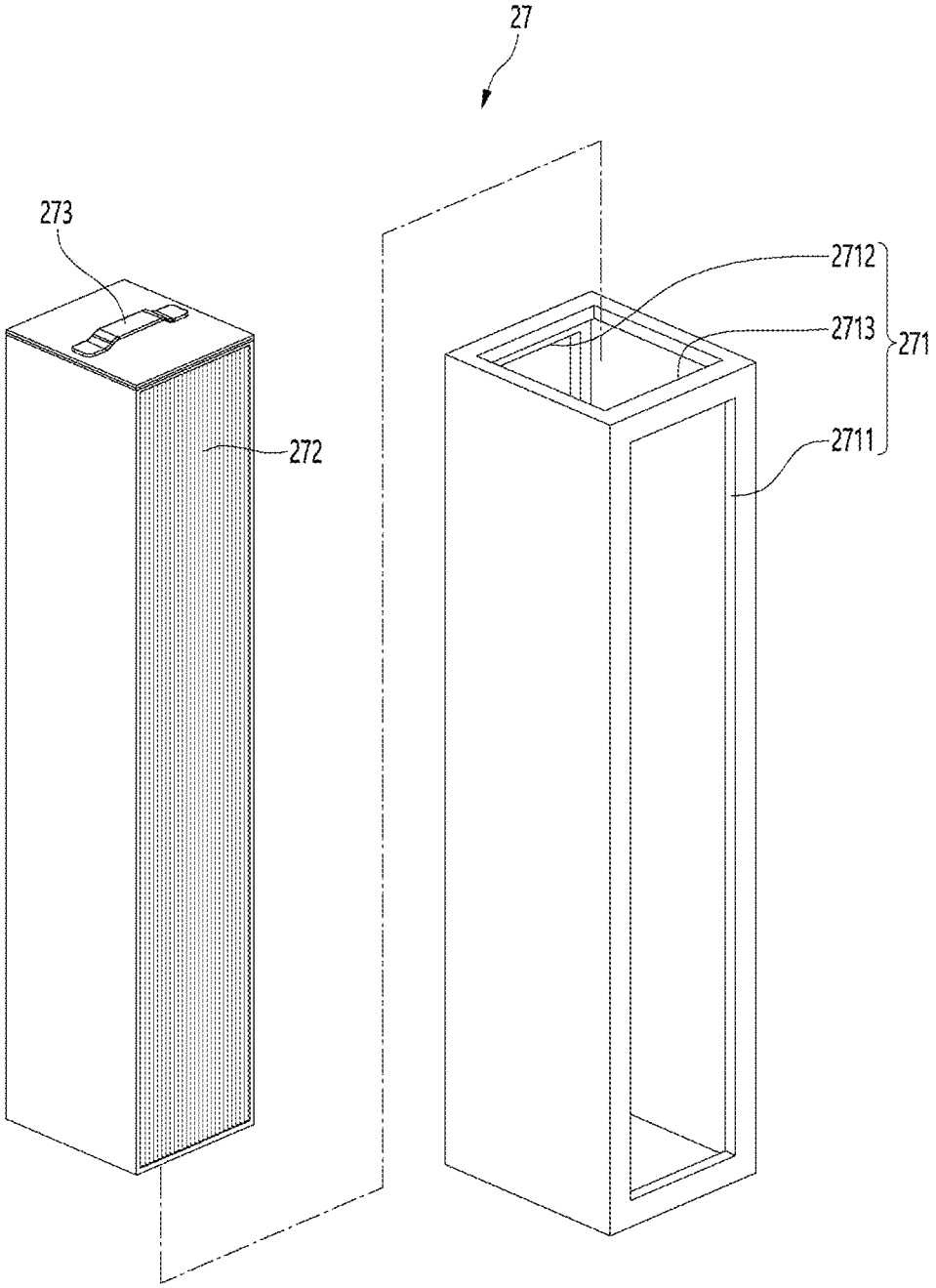
FIG. 12 is an exploded perspective view of the bypass filter unit.

FIG. 11 is a perspective view of a bypass filter unit constituting a ventilation apparatus according to an embodiment of the present invention, and FIG. 12 is an exploded perspective view of the bypass filter unit.

Referring to FIGS. 11 and 12, the bypass filter unit 27 according to an embodiment of the present invention includes a filter case 271 and a filter 272 inserted into the filter case 271.

In detail, a handle 273 is mounted on the upper or lower surface of the filter 272. The handle is a part that the user holds with his or her hand when inserting or withdrawing the filter 272 into the filter case 271.

In addition, a filter insertion hole 2723 is formed on the upper or lower surface of the case 271, and an inlet 2711 and an outlet 2712 are respectively formed on two of the four sides of the case 271 that face each other. And, the inlet 2711 is located on the outlet side of the bypass damper module 24.

Therefore, when the bypass damper module 24 is opened, the outdoor air or indoor air flowing into the outdoor air inlet 113 or the indoor air inlet 111 sequentially passes through the inlet 2711, the filter 272, and the outlet 2712, and then guided to the intake side bypass passage 1313 or the exhaust side bypass passage 1314.

Figure 13:
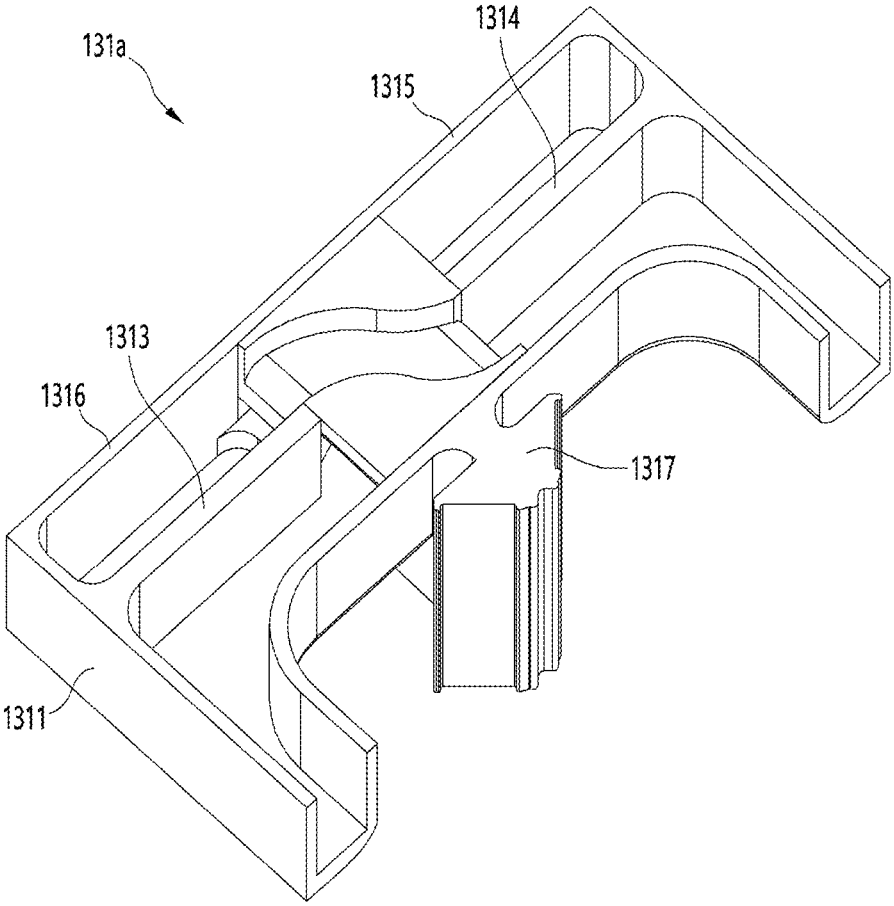
FIG. 13 is a plan perspective view of a bypass guide according to another embodiment of the present invention.
Figure 14:
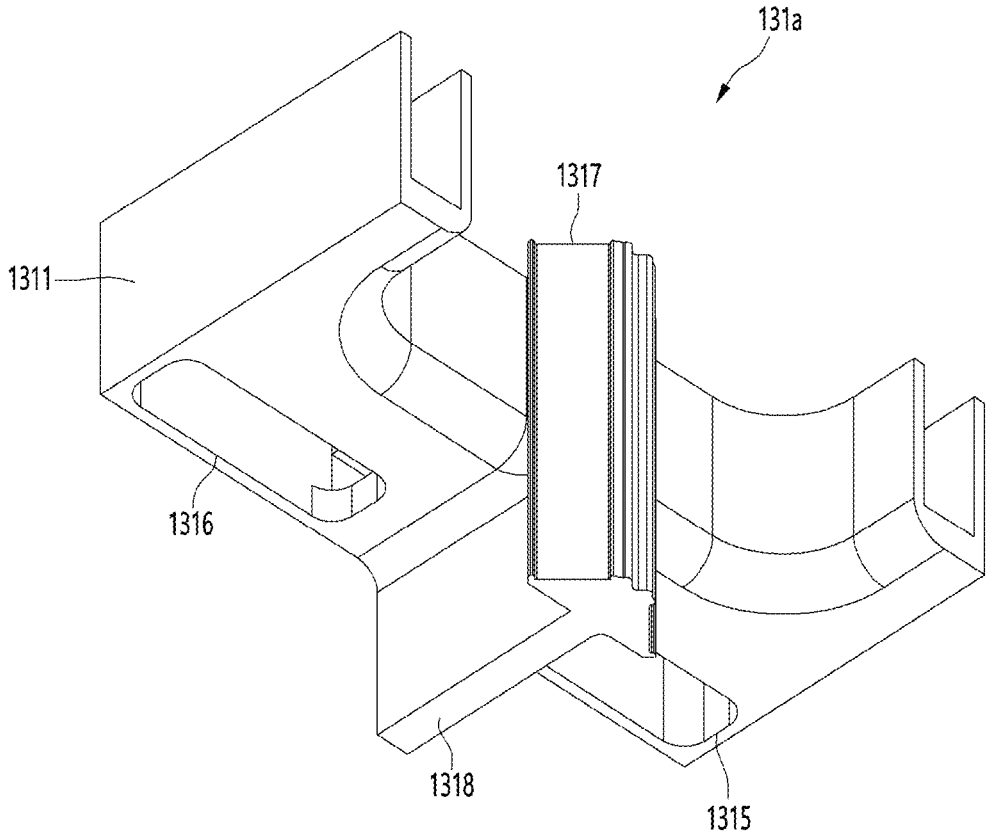
FIG. 14 is a bottom perspective view of the bypass guide.

FIG. 13 is a plan perspective view of a bypass guide according to another embodiment of the present invention, and FIG. 14 is a bottom perspective view of the bypass guide.

Referring to FIGS. 13 and 14, the bypass guide 131*a* according to the present embodiment has the same configuration as the bypass guide 131 according to the previous embodiment, but differs in that there is no vertical portion 1312.

In detail, the inlets of the intake side bypass passage 1313 and the exhaust side bypass passage 1314 are formed at the ends of the horizontal portion 1311. The horizontal portion 1311 may be described as including a rectangular first portion and a pair of second portions extending from both ends of the first portion, similar to the bypass guide 131 of the previous embodiment. The entrances of the intake side bypass passage 1313 and the exhaust side bypass passage 1314 are formed at the ends of the pair of second portions.

The intake side bypass passage 1313 extends from one end of the pair of second parts toward the exhaust guide hole 1316 and then is bent to extend towards the center of the first part. In addition, the exhaust side bypass passage 1314 extends from the other end of the pair of second parts toward the intake guide hole 1315 and then is bent to extend toward the center of the first part.

In addition, a separation wall 1318 extends on the bottom of the central portion of the first portion to partition a space in which the intake fan 14 is accommodated and a space in which the exhaust fan 15 is accommodated. That is, the separation wall 1318 is extended to block mixing of indoor air and outdoor air.

Additionally, the central partition wall 1317 extends from the central end of the first portion and forms one body with the partition wall 1318. Here, an end of the first part from which the pair of second parts and the central partition wall 1317 extend may be defined as an inner end of the first part, and the edge on the side where the intake guide hole 1315 and the exhaust guide hole 1316 are formed may be defined as an outer end of the first part. That is, the inner end and the outer end can be understood as ends facing each other. In addition, the dividing surface bisecting the bypass guide 131*a* passes through the point where the intake side bypass passage 1313 and the exhaust side bypass passage 1314 intersect, to divide the separation wall 1318 and the central partition wall 1317 into two halves.

As the vertical portion 1312 of the bypass guide 131 according to the previous embodiment is removed, the incoming indoor air or outdoor air can be sent selectively to one of the lower and upper spaces of the case 13 or simultaneously to the lower and upper spaces of the case 13. Here, it can be explained that the lower space of the case 13 refers to a space where the bypass passages 1313 and 1314 are formed, and the upper space refers to a space where the intake fan 14 and the exhaust fan 15 are accommodated.

As the vertical portion 1312 of the bypass guide 1313 is removed, it becomes necessary to change the structure of the bypass filter unit disposed at the entrance of the bypass flow passages 1313 and 1314, this will be explained in detail by referring to the drawings below.

Figure 15:
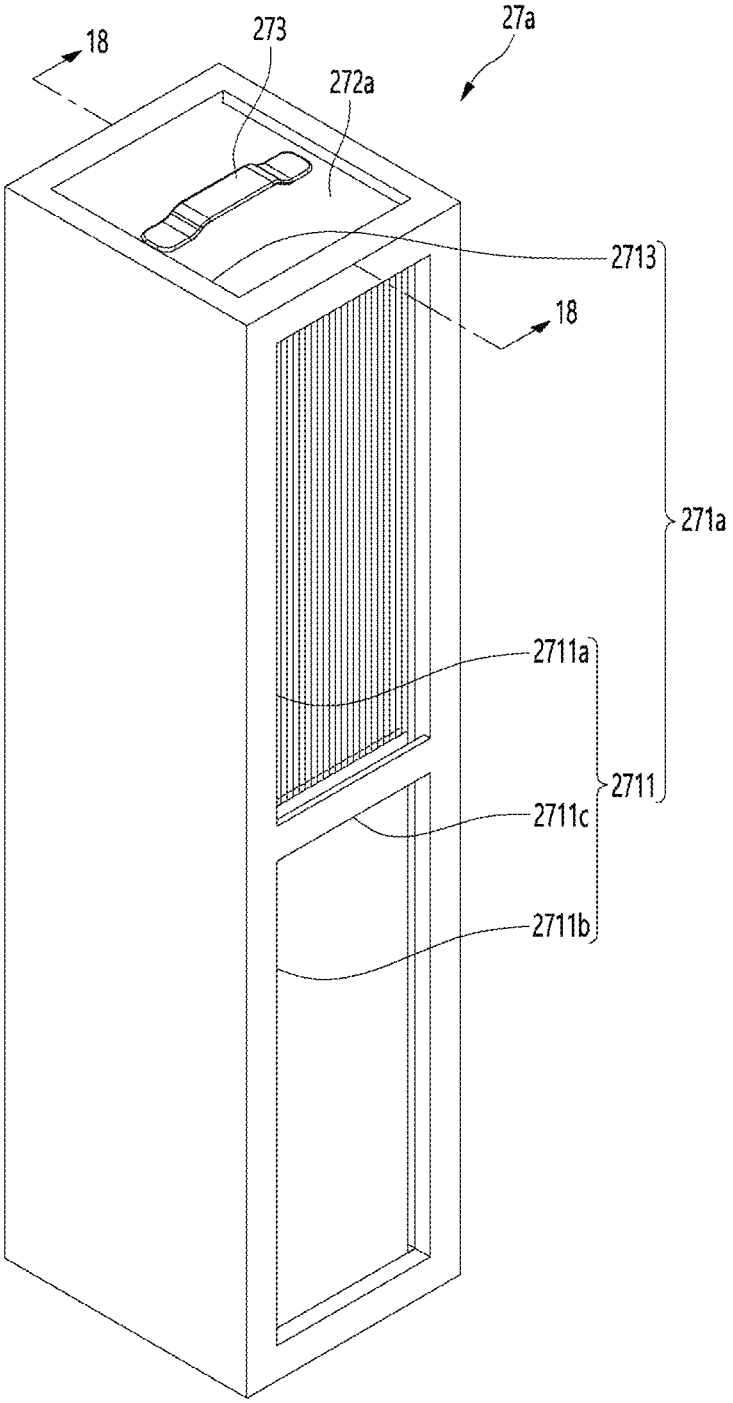
FIG. 15 is a perspective view of a bypass filter unit according to another embodiment of the present invention.
Figure 16:
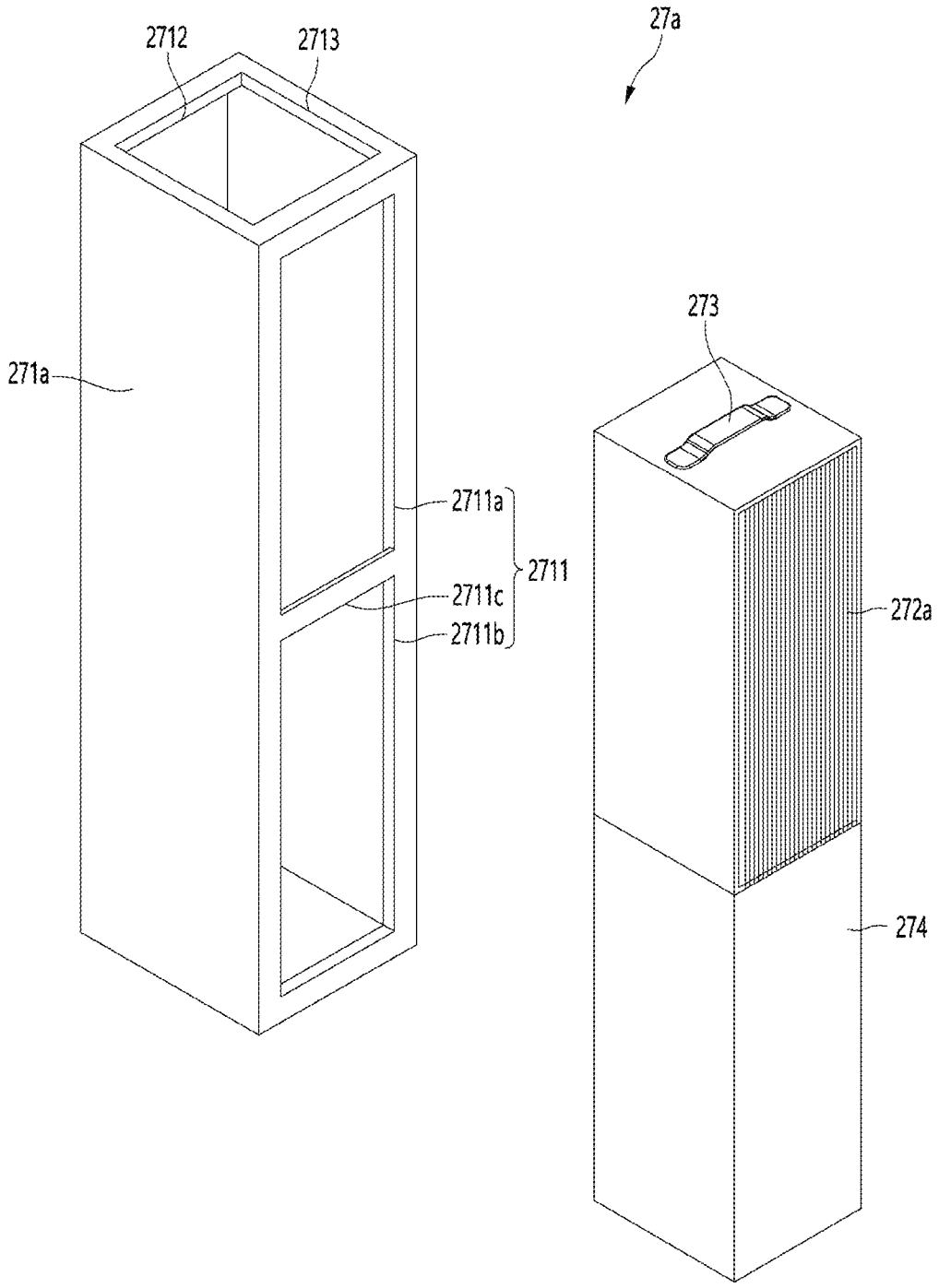
FIG. 16 is an exploded perspective view of the bypass filter unit viewed from the front.
Figure 17:
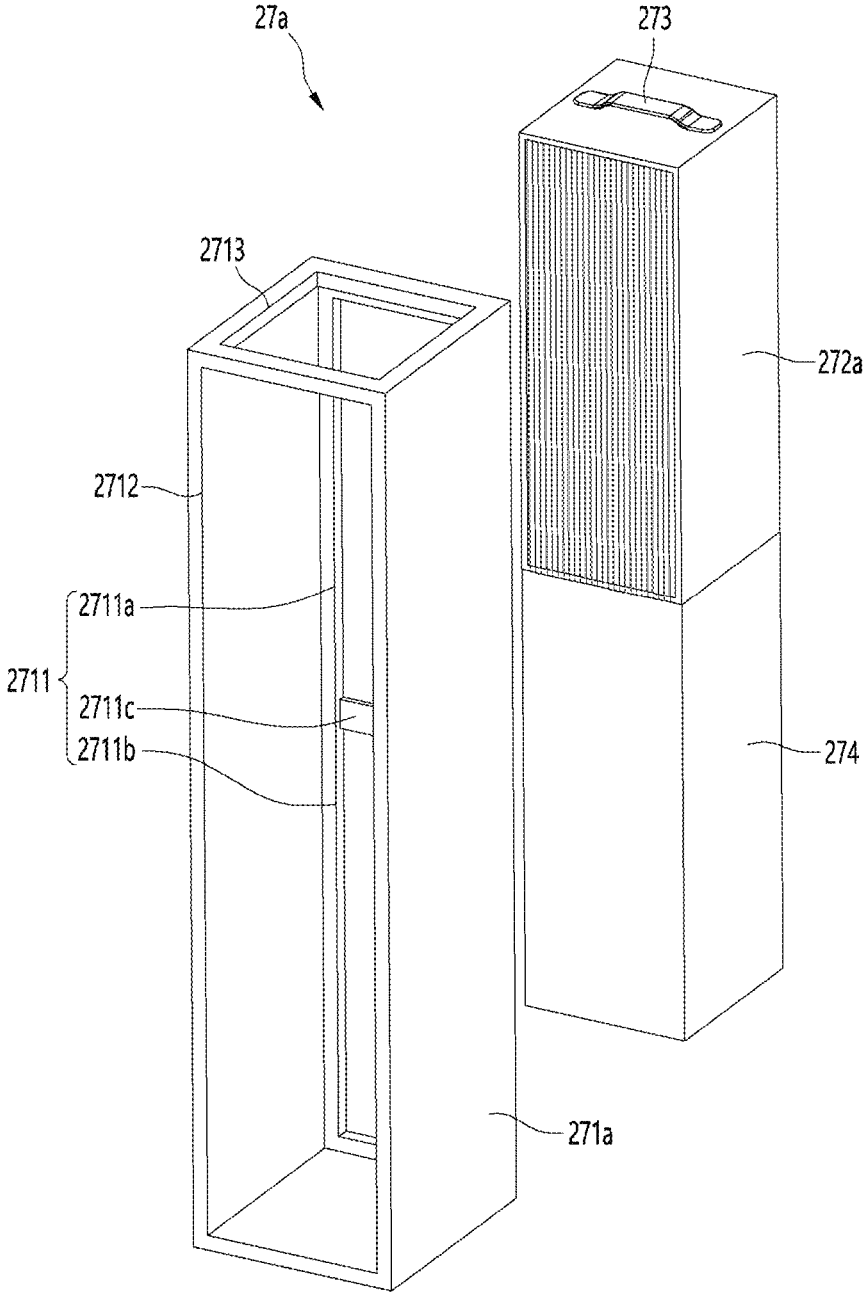
FIG. 17 is an exploded perspective view of the bypass filter unit viewed from the rear.
Figure 18:
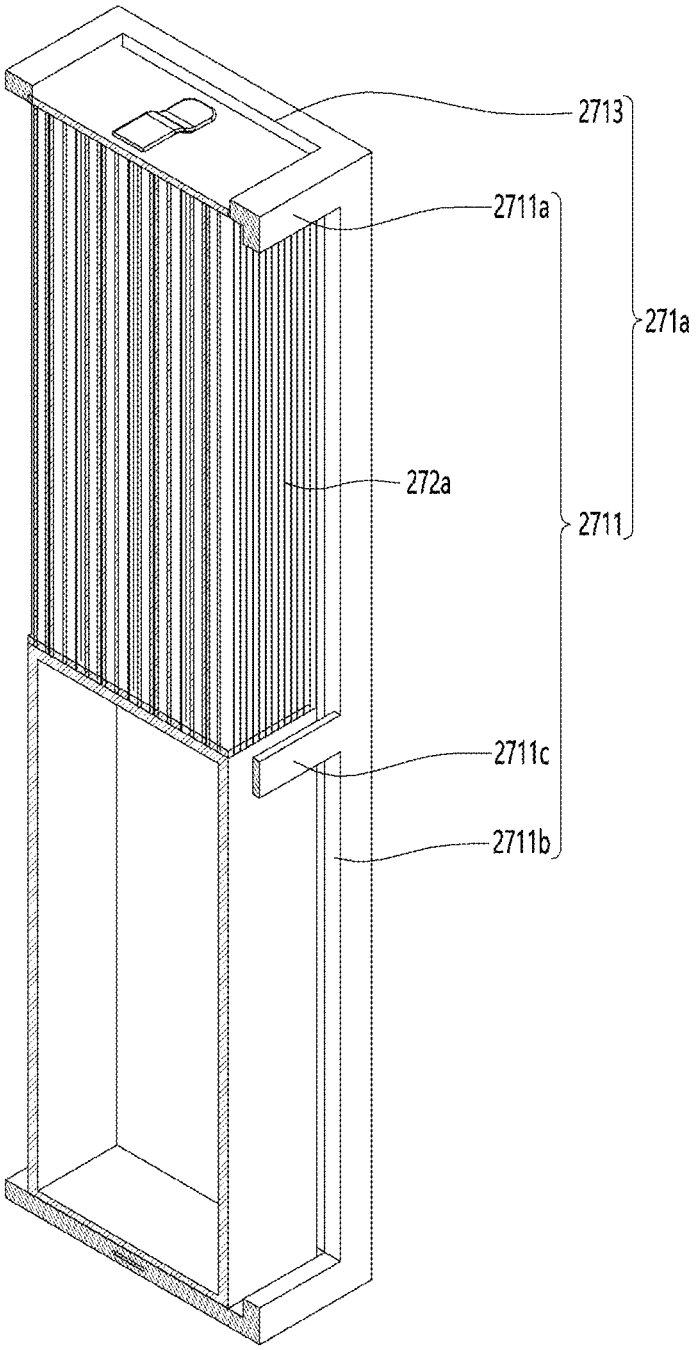
FIG. 18 is a longitudinal cross-sectional view of the bypass filter unit taken along line 18-18 of FIG. 15.

FIG. 15 is a perspective view of a bypass filter unit according to another embodiment of the present invention, FIG. 16 is an exploded perspective view of the bypass filter unit viewed from the front, and FIG. 17 is an exploded perspective view of the bypass filter unit viewed from the rear. FIG. 18 is a longitudinal cross-sectional view of the bypass filter unit cut along line 18-18 in FIG. 15.

Referring to FIGS. 15 to 18, the bypass filter unit 27*a* according to this embodiment includes a filter case 271*a*, a filter 272*a* inserted into the filter case 271*a*, and a blocking block 274 disposed below the filter 272*a*.

In detail, the filter case 271*a* is formed in a rectangular parallelepiped shape as in the previous embodiment, and the filter 272*a* and the blocking block 274 are inserted therein. A filter insertion hole 2713 is formed on the upper surface of the filter case 271*a*, and an inlet 2711 and an outlet 2712 are formed on the front and rear sides of the filter case 271*a*, respectively, and it is similar to the structure of the filter case 271 according to the previous embodiment. However, in this embodiment, there is a difference in that the inlet 2711 is divided into an upper inlet 2711*a* and a lower inlet 2711*b* by a partition rib 2711*c*.

In addition, the filter 272*a* has the same structure as the filter 272 according to the previous embodiment, but has a different length in the vertical direction. Specifically, the filter 272*a* according to the present embodiment may have a length corresponding to half of the length of the filter 272 according to the previous embodiment.

Additionally, the blocking block 274 is inserted into the inner lower side of the filter case 271*a* and functions to shield the lower inlet 2711*b*. Additionally, the filter 272*a* and the blocking block 274 may be formed in one body, and the sum of their lengths may correspond to the length of the filter 272 according to the previous embodiment.

In addition, the bypass filter unit 27*a* is placed on the outlet side of the intake side bypass damper module 22 and the outlet side of the exhaust side bypass damper module 23, respectively, but it is possible to install the bypass filter unit 27*a* upside down according to flow path setting conditions. It can be installed upside down.

For example, when the bypass filter unit 27*a* is coupled to the position where the intake side bypass filter unit is mounted, the filter 272*a* can be positioned above the blocking block 274, and when the bypass filter unit 27*a* is coupled to the position where the exhaust side bypass filter unit is mounted, the combination form may be selected by the assembler so that the blocking block 274 is located on either the lower or upper side of the filter 272*a*.

Figure 19:
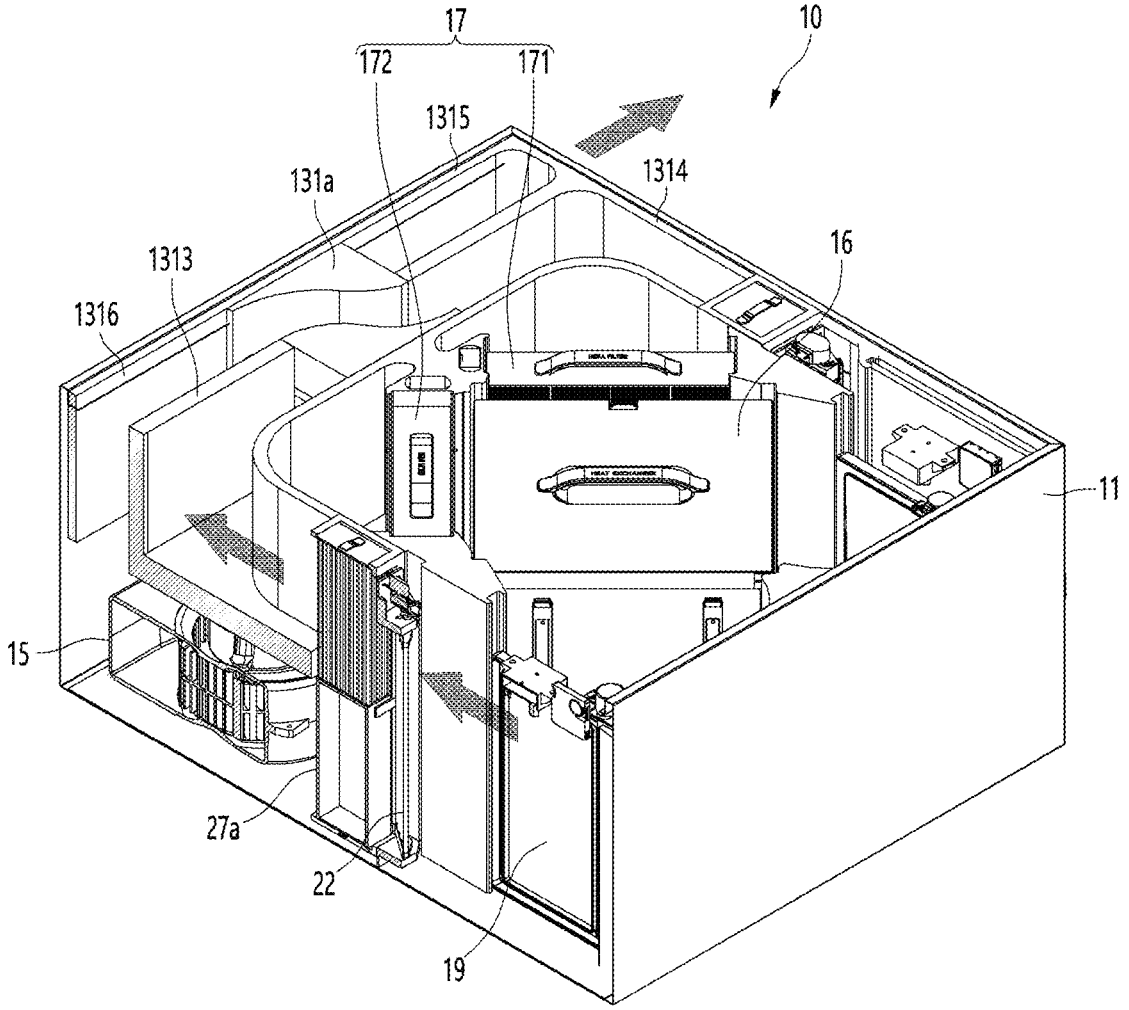
FIG. 19 is a cut-away perspective view of a ventilation device showing the flow of outdoor air when the bypass filter unit described in FIGS. 15 to 18 is installed at the mounting position of the intake side bypass filter unit.

FIG. 19 is a cut-away perspective view of the ventilation device showing the flow of outdoor air when the bypass filter unit described in FIGS. 15 to 18 is installed at the mounting position of the intake side bypass filter unit.

Referring to FIG. 19, the outdoor air sucked through the outdoor air inlet 113 passes through the total heat exchange element 16 to recover waste heat, and is then supplied indoors, or the outdoor air may flow along the intake side bypass passage 1313 to be supplied directly indoors without heat recovery.

On the other hand, since there is no operating mode in which outdoor air sucked through the outdoor air inlet 113 is discharged outdoors again through the indoor air outlet 114, it is not necessary for the outdoor air to be supplied to the upper space of the bypass guide 131*a*. Accordingly, when the bypass filter unit 27*a* is mounted at the outlet of the intake side bypass damper module 22, the blocking block 274 may be positioned above the filter 272*a*. Here, when the ventilation device 10 is mounted on the indoor ceiling, the handle 273 of the total heat exchange element 16 and the filter 272*a* faces the indoor floor. Accordingly, when installation of the ventilation device 10 is completed, the blocking block 274 can be viewed as being located above the filter 272*a*.

In addition, the outdoor air flowing into the ventilation device 10 through the outdoor air inlet 113 may flow to one side of or both sides the total heat exchange element 16 and the intake side bypass passage 1313 depending on whether the intake side main damper module 19 and the intake side bypass damper module 22 are opened or closed.

Figure 20:
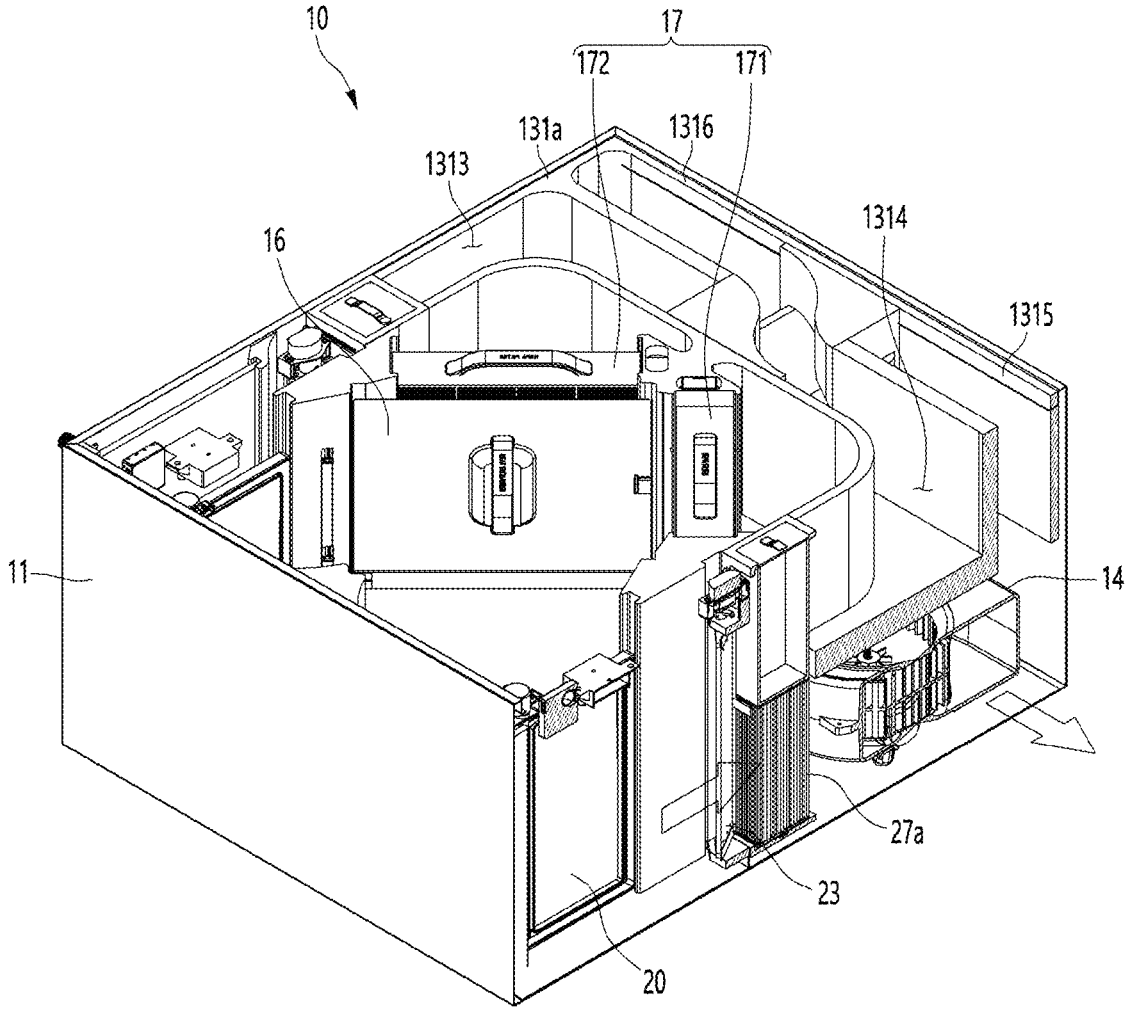
FIG. 20 is a cut-away perspective view of a ventilation device showing the flow of indoor air when the bypass filter unit described in FIGS. 15 to 18 is installed at the mounting position of the exhaust side bypass filter unit.

FIG. 20 is a cut-away perspective view of the ventilation device showing the flow of indoor air when the bypass filter unit described in FIGS. 15 to 18 is installed at the mounting position of the exhaust side bypass filter unit.

Referring to FIG. 20, the air flowing into the ventilation device 10 through the indoor air inlet 111 passes through the total heat exchange element 16 and is discharged to the outdoors after recovering waste heat, or may flow along the exhaust side bypass passage 1314 to be discharged to the outdoors without waste heat recovery.

In detail, according to the structure of the bypass guide 131*a* according to the present embodiment, the vertical portion 1312 is removed, and a bypass filter unit 27*a* including a filter 272*a* and a blocking block 274 is provided instead. Therefore, as shown in Figure, the bypass filter unit 27*a* may be assembled such that the filter 272*a* is located in the space where the intake fan 14 is installed. Then, the indoor air flowing into the ventilation device 10 through the indoor air inlet 111 may be purified while passing through the filter 272*a* and then supplied back into the indoors by the intake fan 14, and this air circulation mode can be defined as an indoor air purification mode.

As described above, since there is need that the indoor air should be directly re-supplied indoors after flowing into the ventilation device 10 without passing through the total heat exchange element 16 or the exhaust side bypass passage 1314, depending on the operation mode, the mounting position of the filter 27*a* may be appropriately selected depending on the purpose.

For example, as shown, in the state where the installation of the ventilation device 10 is completed and the blocking block 274 is located below the filter 272*a*, the execution of the indoor air ventilation mode is impossible that the indoor air is bypassed without waste heat recovery and discharged to the outdoors without waste heat recovery. On the contrary, when the blocking block 274 is located above the filter 272*a*, execution of the indoor air purifying mode described above is impossible.

Figure 21:
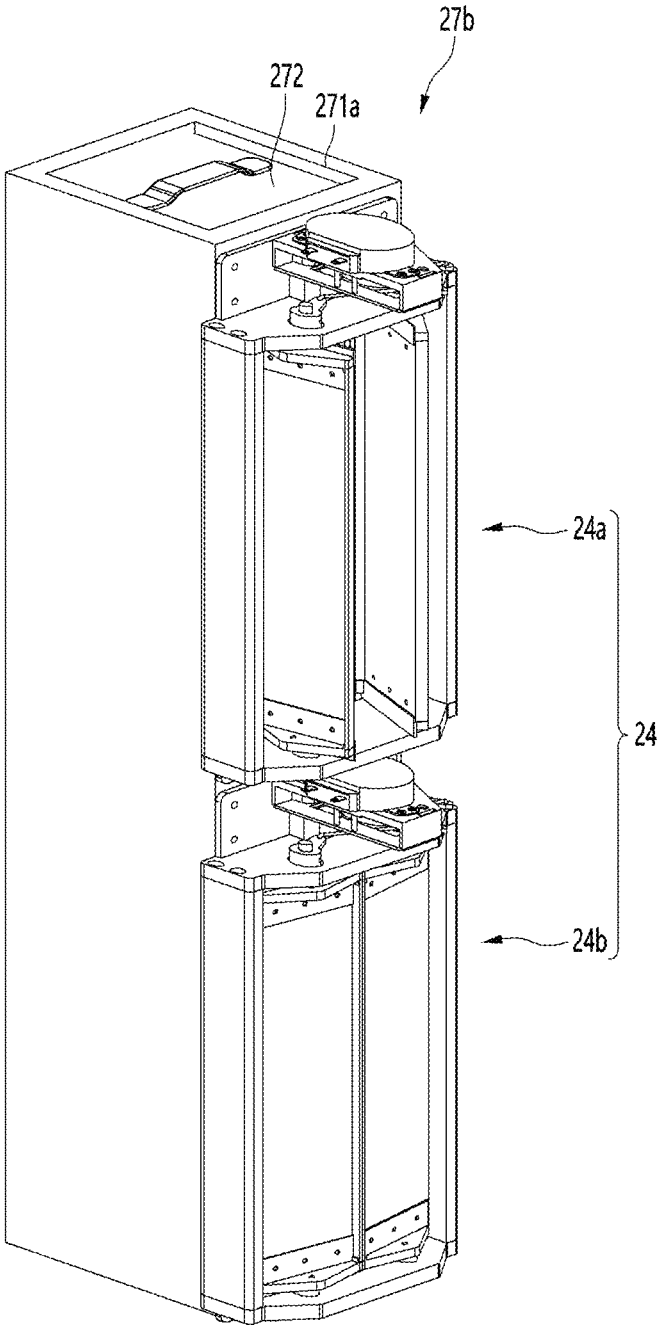
FIG. 21 is a perspective view of a bypass series including a pi-pass filter unit and a bypass damper module according to another embodiment of the present invention.
Figure 22:
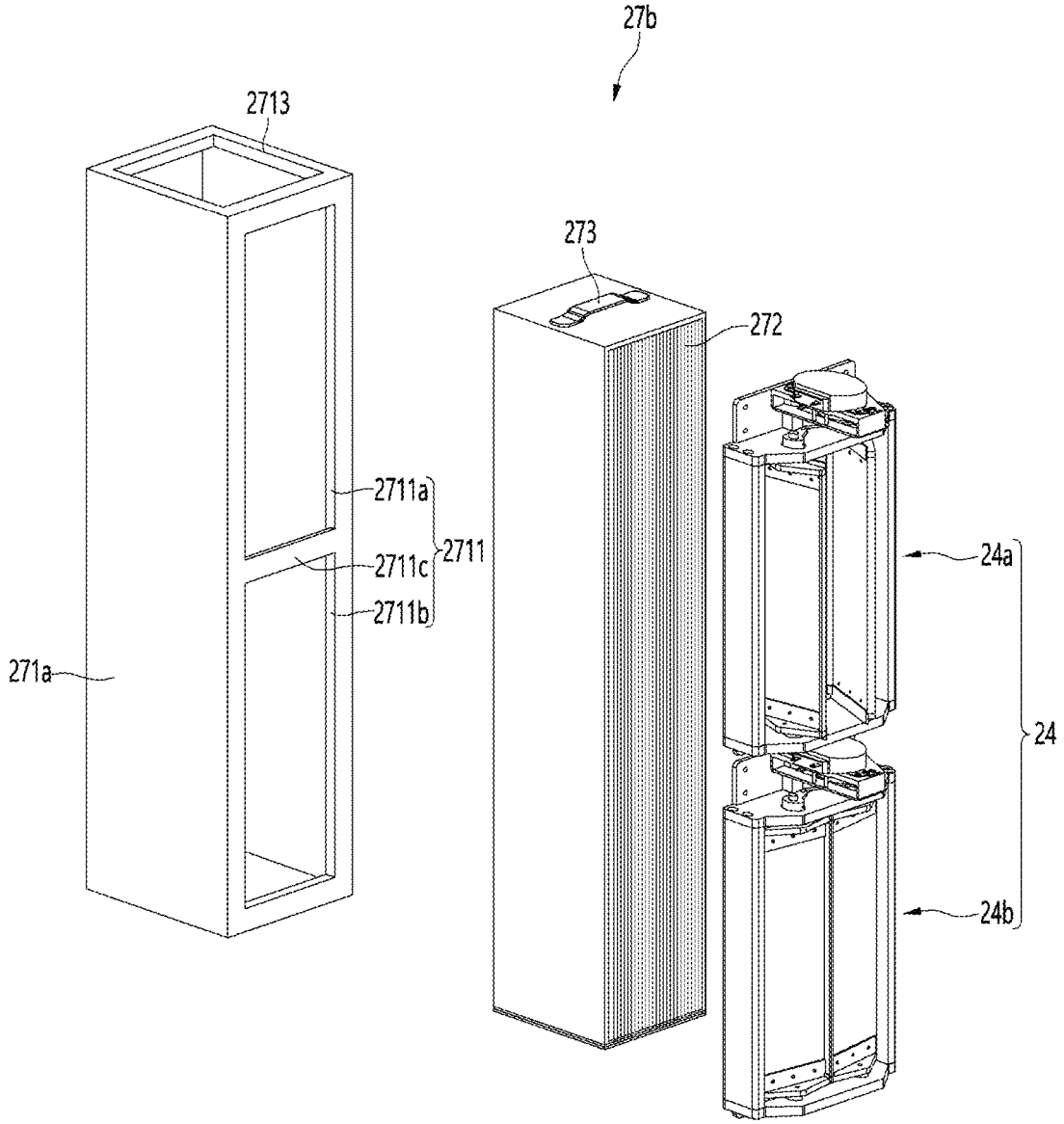
FIG. 22 is a front exploded perspective view of the bypass series.
Figure 23:
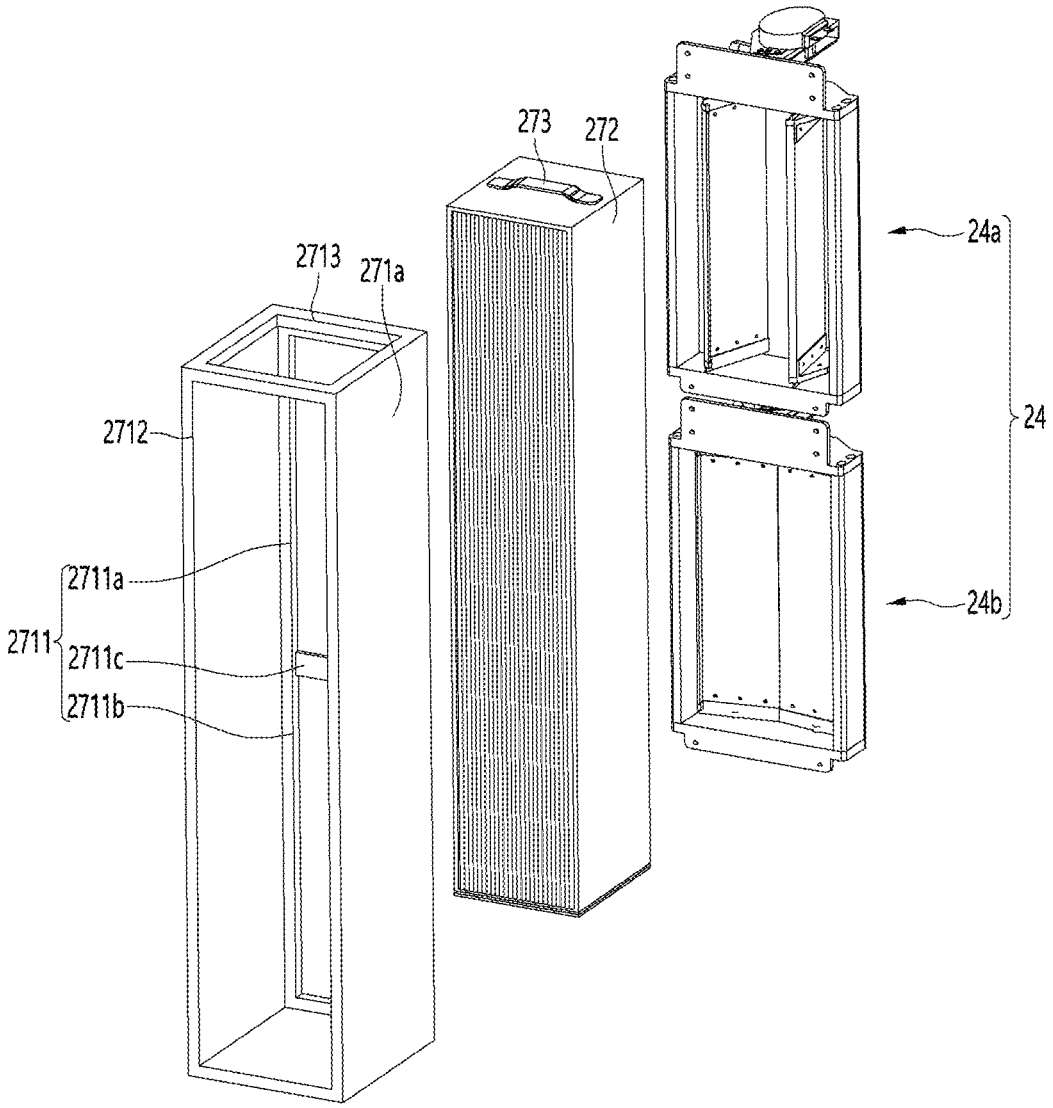
FIG. 23 is a rear exploded perspective view of the bypass series.

FIG. 21 is a perspective view of a bypass series including a pi-pass filter unit and a bypass damper module according to another embodiment of the present invention, FIG. 22 is a front exploded perspective view of the bypass series, and FIG. 23 is a perspective view of the bypass series. This is a rear exploded perspective view of the series.

Referring to FIGS. 21 to 23, the bypass filter unit 27*b* according to another embodiment of the present invention includes the filter 272 illustrated in FIGS. 11 and 12 and the filter case 271*a* illustrated in FIGS. 6 to 18.

In addition, the bypass damper module 24 according to another embodiment of the present invention includes an upper bypass damper module 24*a* and a lower bypass damper module 24*b* placed below the upper bypass damper module 24*a*.

In detail, each of the upper and lower bypass damper modules 24*a* and 24*b* has the same configuration as the bypass damper module described in FIGS. 9 and 10, but has a shorter length of less than half. That is, in this embodiment, the upper bypass damper module 24*a* and the lower bypass damper module 24*b* are disposed at the upper inlet 2711*a* and the lower inlet 2711*b* of the filter case 271*a*, respectively, such that the upper inlet 2711*a* and the lower inlet 2711*b* are opened or closed independently from each other.

Since the structures of the upper bypass damper module 24*a* and the lower bypass damper module 24*b* are the same as those of the bypass damper module described in FIGS. 9 and 10, redundant descriptions will be omitted. And, since the filter case 271*a* has the same configuration as the filter case 271*a* described in FIGS. 15 to 18, and the filter 272 has the same configuration as the filter 272 described in FIG. 11, Redundant explanations are omitted.

Figure 24:
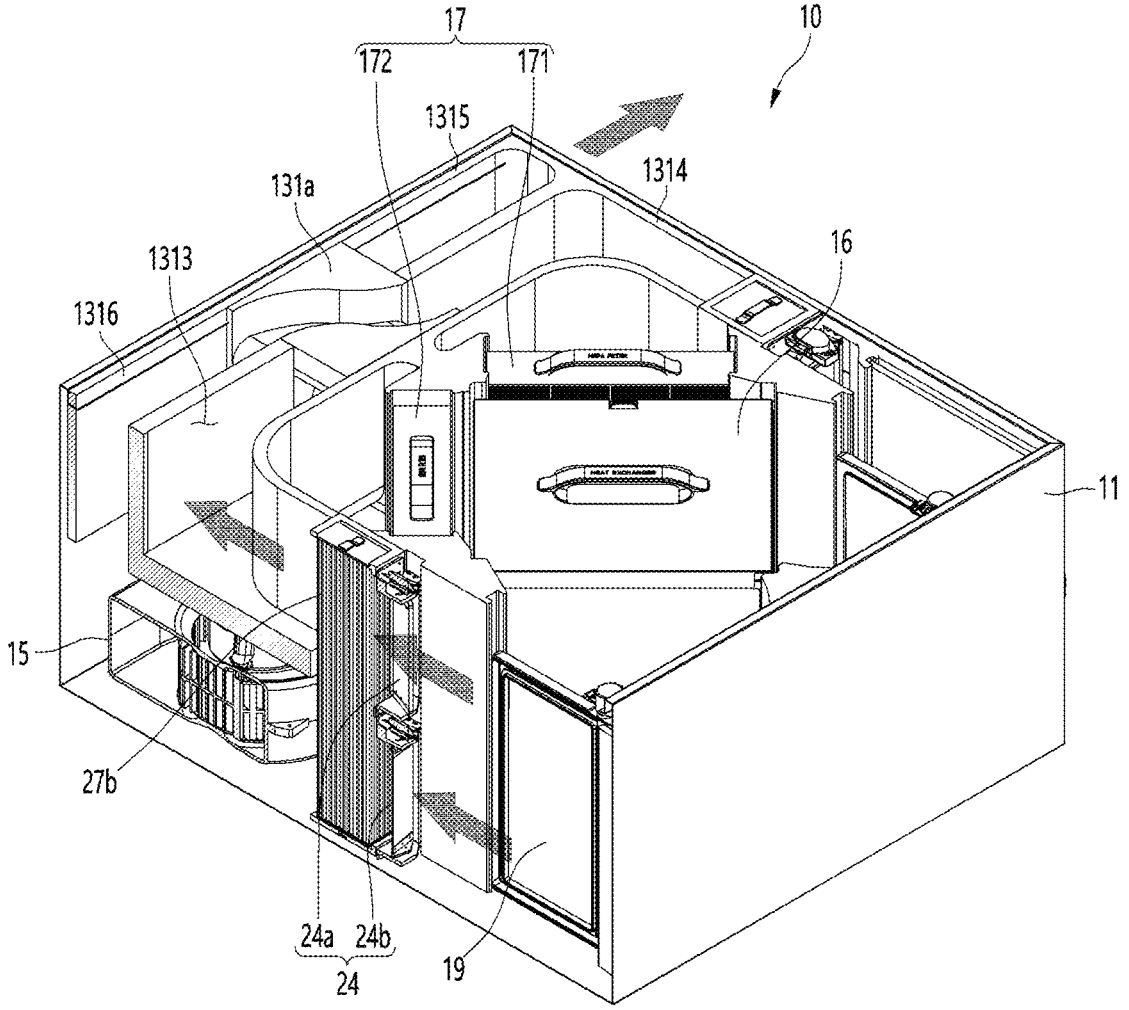
FIG. 24 is a cut-away perspective view of a ventilation device showing the flow of outdoor air when the bypass series shown in FIG. 21 is installed on the intake side.

FIG. 24 is a cut-away perspective view of a ventilation device showing the flow of outdoor air when the bypass series shown in FIG. 21 is installed on the intake side.

Referring to FIG. 24, when the intake side main damper module 19 is opened, the outdoor air flowing in through the outdoor air inlet 113 passes through the total heat exchange element 16 and then supplied indoors through the outside air discharge port 114.

When the intake side main damper module 19 is closed, the upper bypass damper module 24*a* is open, and the lower bypass damper module 24*b* is closed, the outdoor air flowing in through the outdoor air inlet 113 is guided to the intake side bypass passage 1313 after passing through the upper part of the bypass filter unit 27*b*, and then is supplied indoors through the outdoor air outlet 114. At this time, when the upper bypass damper module 24*a* and the intake side main damper module 19 are opened simultaneously, part of the outdoor air passes through the total heat exchange element 16, and the remaining part is supplied indoors after passing through the intake side bypass passage 1313.

Figure 25:
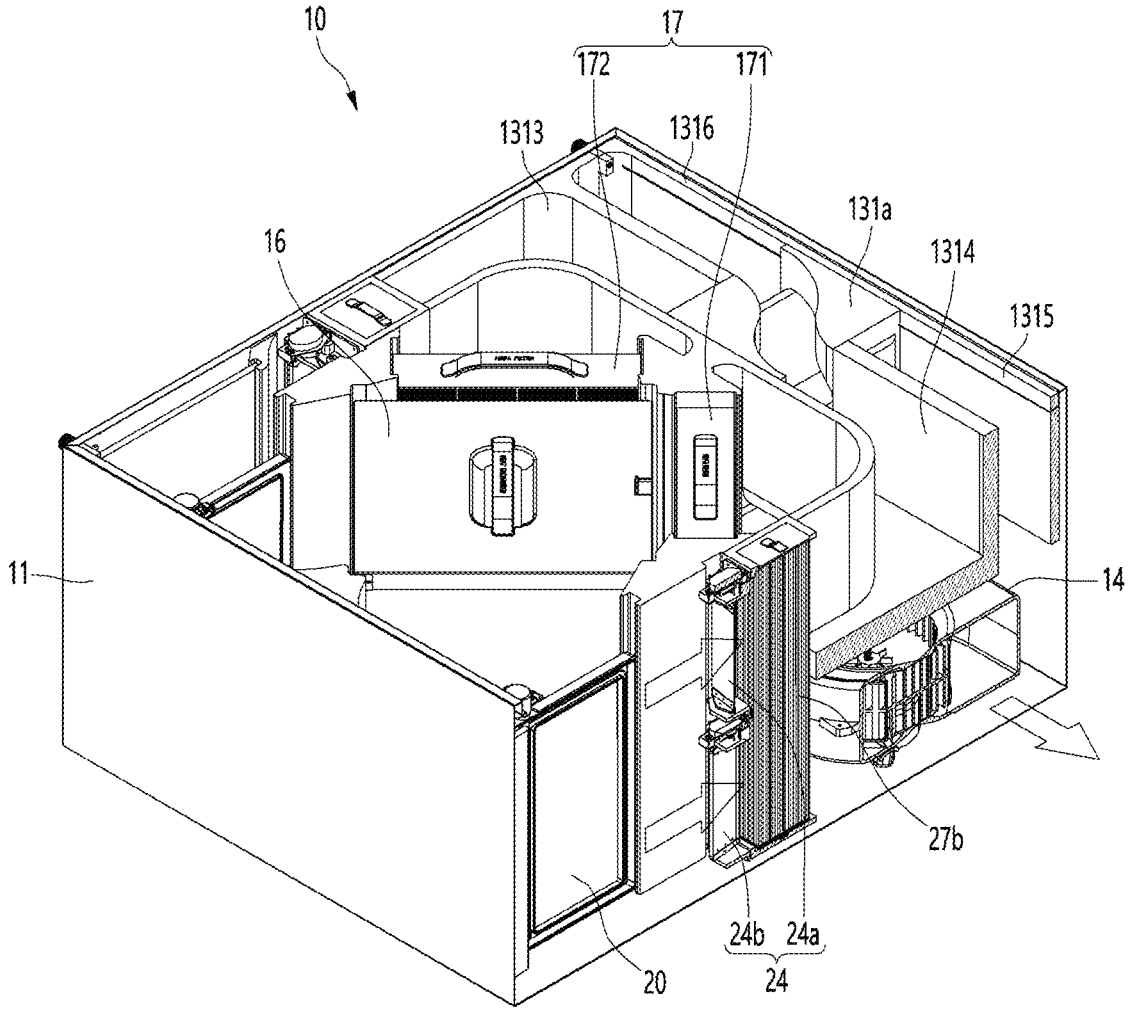
FIG. 25 is a cut-away perspective view of a ventilation device showing the flow of outdoor air when the bypass series shown in FIG. 21 is installed on the exhaust side.

FIG. 25 is a cut-away perspective view of a ventilation device showing the flow of outdoor air when the bypass series shown in FIG. 21 is installed on the exhaust side.

Referring to FIG. 25, when the exhaust side main damper module 20 is opened, the indoor air flowing in through the indoor air inlet 111 passes through the total heat exchange element 16 and then is discharged outdoors through the indoor air outlet 112.

In detail, when the exhaust side main damper module 20 is closed and the upper bypass damper module 24*a* is opened, indoor air flows along the exhaust side bypass passage 314 and is discharged outdoors through the exhaust outlet 112.

On the other hand, when the exhaust side main damper module 20 is closed and the lower bypass damper module 24*b* is opened, indoor air flows into the space where the intake fan 14 is accommodated and is supplied back to indoors.

In this way, by selecting the operation mode, at least one of the exhaust side main damper module 20, the upper bypass damper module 24*a*, and the lower bypass damper module 24*b* may be opened, and the indoor air flowing into the indoor air inlet 111 may be re-supplied to indoors depending on the opening of the damper module.

Hereinafter, how the ventilation device is operated according to the degree of indoor air pollution by carbon dioxide, the dust concentration of outdoor air, and the dust concentration of indoor air will be described in detail with reference to the flow chart.

Figure 26:
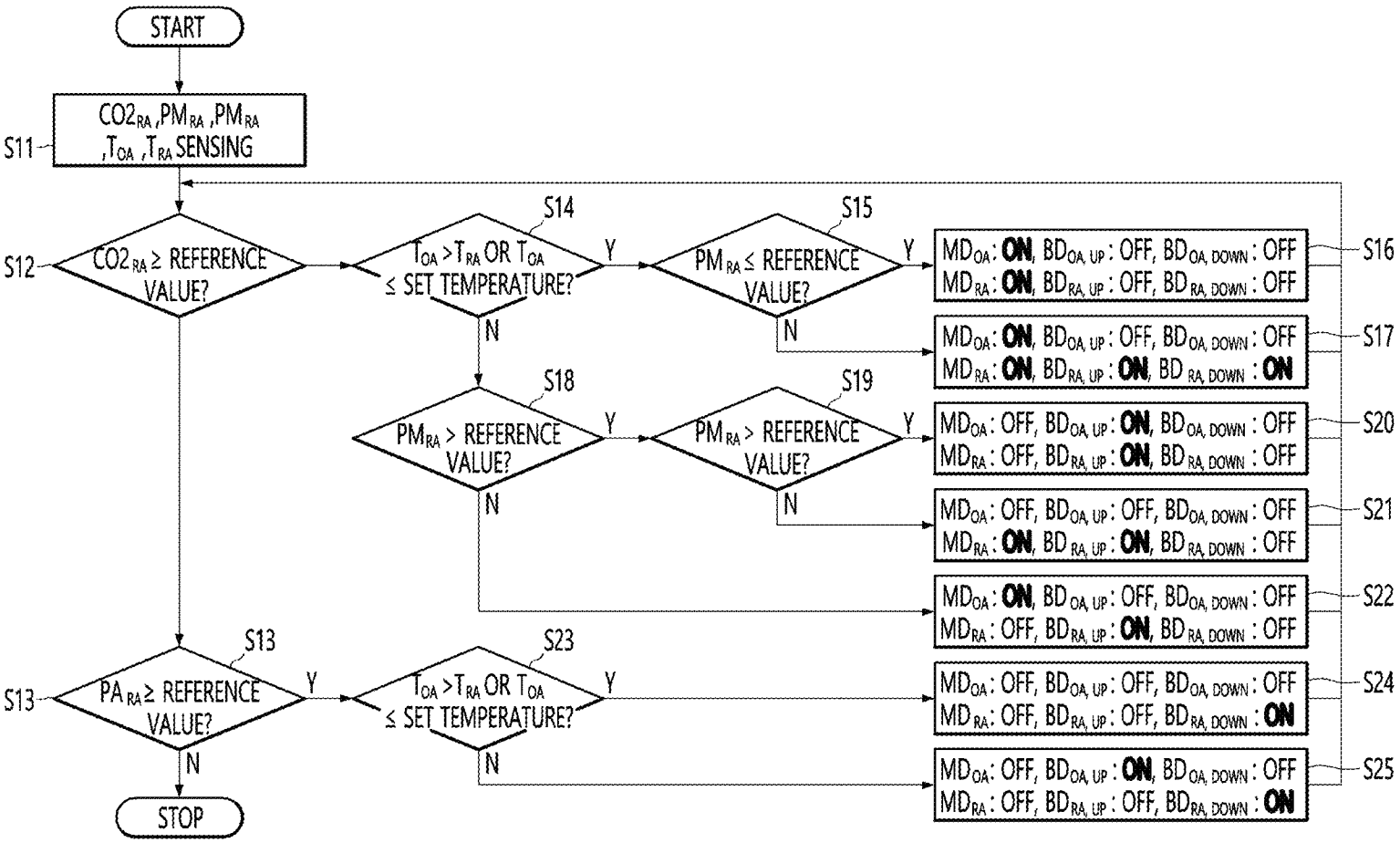
FIG. 26 is a flow chart showing a control method of a ventilation device according to an embodiment of the present invention.

FIG. 26 is a flow chart showing a control method of a ventilation device according to an embodiment of the present invention.

Referring to FIG. 26, the operation of the ventilation device 10 according to the embodiment of the present invention described in FIGS. 21 to 25 may be classified to a total heat exchange ventilation, and a bypass ventilation, and an indoor circulating air purification.

In detail, electric ventilation operation allows both outdoor air (OA: outdoor air) and indoor air (RA: room air) to pass through the heat exchange element to recover energy during the ventilation operation process, thereby saving energy at the same time.

The bypass ventilation operation refers to an operation in which outdoor air and indoor air do not pass through the heat exchange element at the same time, and refers to an operation performed in a situation that does not require energy recovery. The bypass ventilation operation includes an operation in which only one of outdoor air and indoor air passes through the total heat exchange element, or neither outdoor air nor indoor air passes through the total heat exchange element.

Firstly, the operation in which neither outdoor nor indoor air passes through the total heat exchange element may be selected in case where the outdoor temperature (TOA) and the indoor temperature (TRA) are similar, so there is no need for waste heat recovery through the total heat exchange element, and the outdoor dust concentration (PMOA) and the dust concentration (PMRA) are rather high indoor temperature are similar.

Secondly, the operation in which only outdoor air passes through the heat exchange element may be selected when it is desired to prevent outdoor air from passing through the heat exchange element in order to protect the expensive heat exchange element because the outdoor dust concentration is somewhat stable but the indoor dust concentration is somewhat high.

Thirdly, the operation in which only indoor air passes through the heat exchange element may be selected when it is desired to prevent outdoor air from passing through the heat exchange element because the indoor dust concentration is stable but the outdoor dust concentration is somewhat high.

Here, when comparing the flow pressure loss that occurs when air passes through the bypass passage and the flow pressure loss that occurs when air passes through the total heat exchange element, although the flow pressure loss due to the bypass passage is higher than the flow pressure loss due to the total heat exchange element, the operation control is required to protect the expensive heat exchange elements.

The indoor circulating air purification refers to an operation in which indoor air flows into the ventilation device, passes through the exhaust side bypass filter, and is then resupplied indoors, so that dust contained in the indoor air is filtered out.

Before explaining the control, define terms first.

Hereinafter, the outdoor main damper module (MDOA) refers to the intake side main damper module 19, and the indoor main damper module (MDRA) refers to the exhaust side main damper module 20.

Additionally, the outdoor bypass passage refers to the intake side bypass passage 1313, and the indoor bypass passage refers to the exhaust side bypass passage 1314.

And, the outdoor bypass damper module refers to the intake side bypass damper module 22, and includes the outdoor upper bypass damper module (BDOA, H) and the outdoor lower bypass damper module (BDOA, L). In addition, the outdoor upper bypass damper module refers to the upper bypass damper module 24*a* disposed between the outdoor air inlet 113 and the indoor air outlet 112, and the outdoor lower bypass damper module refers the lower bypass damper module 24*b* disposed between the outdoor air inlet 113 and the indoor air outlet 112.

In addition, the indoor bypass damper module refers to the exhaust side bypass damper module 23 and includes an indoor upper bypass damper module (BDRA, H) and an indoor lower bypass damper module (BDRA, L). do. And, the indoor upper bypass damper module refers to the upper bypass damper module 24*a* disposed between the indoor air inlet 111 and the outdoor air discharge port 114, and the indoor lower bypass damper module refers to the indoor air inlet 111 and the lower bypass damper module 24*b* disposed between the outside air outlet 114.

Additionally, 'damper on' means 'damper open', and 'damper off' means 'damper closed'.

Meanwhile, in order to control the ventilation device 10 according to the present invention, a sensor for detecting the concentration of carbon dioxide (eg, a VOC sensor), a dust sensor for detecting indoor and outdoor dust concentration, and a sensor for detecting indoor and outdoor temperature are installed in the ventilation device 10 to detect carbon dioxide concentration, outdoor dust concentration, indoor dust concentration, outdoor temperature, and indoor temperature, and these detected values are transmitted to the control unit of the ventilation device 10 (S11).

Additionally, the control unit determines whether the indoor carbon dioxide concentration is above the reference value (S12), and if it is determined that the carbon dioxide concentration is below the reference value, it determines whether the indoor dust concentration is above the reference value (S13). And, if the indoor dust concentration is below the reference value, the control unit stops the operation of the ventilation device 10.

On the other hand, if it is determined that the indoor dust concentration is higher than the reference value, it is determined whether the outdoor temperature is higher than the indoor temperature or whether the outdoor temperature is below the set temperature (S23). In detail, if the indoor dust concentration is higher than the reference value and the outdoor temperature is determined to be higher than the indoor temperature or the outdoor temperature is lower than the set temperature, the outdoor main damper module, the indoor main damper module, the outdoor upper bypass damper module, the outdoor lower bypass damper module, the indoor upper bypass damper module are closed, and only the indoor lower bypass damper module may be opened (S24).

In summary, if the indoor carbon dioxide concentration is below the reference value, but the indoor dust concentration is above the reference value, and the outdoor temperature is higher than the indoor temperature or the outdoor temperature is below the set temperature, only the indoor circulating air purification is performed, such that the dust contained in the indoor air is filtered and the filtered indoor air is supplied back into indoors.

In addition, if the indoor carbon dioxide concentration is below the reference value, but the outdoor temperature is higher than the set temperature and lower than the indoor temperature, only the outdoor upper bypass damper module and the indoor lower bypass damper module are opened, so that the outdoor air detours the total heat exchange element 16 to be supplied to indoors, and the indoor air is supplied back into indoors by the intake fan 14 after passing through the exhaust-side bypass filter unit (S25). In other words, the bypass ventilation and the indoor circulating air purification may be performed simultaneously.

Meanwhile, if it is determined that the indoor carbon dioxide concentration is above the reference value, it is determined whether the outdoor temperature is higher than the indoor temperature or whether the outdoor temperature is below the set temperature (S14). And, when the indoor and outdoor temperature conditions are satisfied, it is further determined whether the indoor dust concentration is below the reference value (S15).

Then, when it is determined that the indoor dust concentration is below the reference value, both the outdoor main damper module and the indoor main damper module are opened to perform an electric heat ventilation operation that allows indoor and outdoor air to pass through the heat exchange element 16 (S16).

On the other hand, if it is determined that the indoor dust concentration exceeds the reference value, the total heat exchange ventilation is performed in the same manner, but in addition, the indoor lower bypass damper module is opened so that the indoor circulating air purification that the indoor air supplied back into indoors after being filtered by the exhaust side bypass filter unit 26 may be additionally performed (S17).

Additionally, if the outdoor temperature is determined to be higher than the set temperature and lower than the indoor temperature, and the indoor/outdoor temperature conditions in step S14 are not satisfied, it is determined whether the outdoor dust concentration exceeds the reference value (S18). First, if it is determined that the outdoor dust concentration exceeds the reference value, it is determined whether the indoor dust concentration also exceeds the reference value (S19).

Then, when it is determined that both the indoor and outdoor dust concentrations exceed the reference value, the indoor and outdoor main damper modules are closed and the indoor and outdoor upper bypass damper modules are opened to protect the heat exchange element 16 (S20). Then, the outdoor air flows along the outdoor bypass passage, that is, the intake side bypass passage 1313, and is supplied indoors, and the indoor air flows to the outdoors along the indoor bypass passage, that is, the exhaust side bypass passage 1314, and is discharged outdoors. Here, since the indoor dust concentration is higher than the reference value, the indoor lower bypass damper module may be opened together to perform the indoor circulating air purification.

On the other hand, if it is determined that the outdoor dust concentration exceeds the reference value but the indoor dust concentration is below the reference value, only the indoor main damper module and the outdoor upper bypass damper module may be opened (S21). Then, only the bypass ventilation is performed in which the outdoor air is supplied directly into indoors along the outdoor bypass passage, and the indoor air passes through the indoor main damper module and the heat exchange element 16 to be discharged outdoors.

Meanwhile, in the state where the outdoor temperature is higher than the set temperature and the indoor temperature is lower than the indoor temperature, if the outdoor dust concentration is determined to be below the reference value, the outdoor main damper module is turned on and the outdoor air is supplied indoors after passing through the heat exchange element 16. Also, since the temperature difference between indoor and outdoor is not large, only the indoor upper bypass damper module can be opened so that the indoor air is discharged outdoors through the indoor bypass passage without exchanging heat with the outdoor air.

What is claimed is:

1. A ventilation apparatus, comprising:

a housing, including:

an indoor air inlet and an outdoor air outlet which are formed to be spaced apart from each other on one side; and an outdoor air inlet and an indoor air outlet which are formed to be spaced apart from each other on the other side corresponding to an opposite side of the one side, wherein the outdoor air inlet is formed at a position opposite to the indoor air inlet and the indoor air outlet is formed at a position opposite to the outdoor air outlet;

a case accommodated in the housing;

an intake fan mounted inside the case and having an outlet connected to the outdoor air outlet;

an exhaust fan mounted inside the case and having an outlet connected to the indoor air outlet; and an enthalpy heat exchanger mounted inside the case and placed at a point where a flow passage connecting the indoor air inlet and the indoor air outlet and a flow passage connecting the outdoor air inlet and the outdoor air outlet intersect, wherein an intake side bypass passage that guides outdoor air flowing into the outdoor air inlet to a space where the intake fan is located, and an exhaust side bypass passage that guides indoor air flowing into the indoor air inlet to a space where the exhaust fan is located, by bypassing the enthalpy heat exchanger are respectively formed on the case, wherein the intake side bypass passage and the exhaust side bypass passage are configured to intersect at a predetermined point between the indoor air outlet and the outdoor air outlet, wherein the case includes:

an intake guide hole formed at an edge adjacent to the outdoor air outlet and communicating with the space where the intake fan is placed; and an exhaust guide hole formed at an edge adjacent to the indoor air outlet and communicating with the space where the exhaust fan is placed, wherein an outlet of the intake side bypass passage communicates with the intake guide hole, and wherein an outlet of the exhaust side bypass passage communicates with the exhaust guide hole.

2. The ventilation apparatus according to claim 1, wherein the predetermined point is a point where a dividing surface bisecting the case passes between the intake guide hole and the exhaust guide hole.

3. The ventilation apparatus according to claim 2, wherein an inlet of the intake side bypass passage is formed at a point spaced apart from the exhaust guide hole in a direction approaching the outdoor air inlet, and wherein an inlet of the exhaust side bypass passage is formed at a point spaced apart from the intake guide hole in a direction approaching the indoor air inlet.

4. The ventilation apparatus according to claim 3, wherein the intake side bypass passage includes:

a first portion extending from the inlet of the intake side bypass passage towards the exhaust guide hole and bent to extend along an edge of the exhaust guide hole; and a second portion bent at an end of the first portion to communicate with the intake guide hole, and wherein the exhaust side bypass passage includes:

a third portion extending from the inlet of the exhaust side bypass passage towards the intake guide hole and bent to extend along an edge of the intake guide hole; and a fourth portion bent at an end of the second portion to communicate with the exhaust guide hole.

5. The ventilation apparatus according to claim 4, wherein the second portion intersects the fourth portion while passing above or below the fourth portion, and wherein the dividing surface passes a point where the second portion and the fourth portion intersect.

6. The ventilation apparatus according to claim 3, further comprising:

an intake side bypass damper module placed on the inlet of the intake side bypass passage; and an exhaust side bypass damper module placed on the inlet of the exhaust side bypass passage.

7. The ventilation apparatus according to claim 6, further comprising:

an intake side bypass filter unit placed between the inlet of the intake side bypass passage and the intake side bypass damper module; and an exhaust side bypass filter unit placed between the inlet of the exhaust side bypass passage and the exhaust side bypass damper module.

8. The ventilation apparatus according to claim 7, further comprising:

an intake side pre-filter installed at the outdoor air inlet; and an exhaust side pre-filter installed at the indoor air inlet.

9. The ventilation apparatus according to claim 8, wherein the enthalpy heat exchanger includes four side surfaces facing four corners of the housing, respectively, wherein the four side surfaces include:

a first side surface facing the outdoor air inlet;

a second side surface facing the outdoor air outlet and being an opposite side of the first side surface;

a third side surface facing the indoor air inlet; and a fourth side surface facing the indoor air outlet and being opposite side of the third side surface, and wherein the dividing surface is configured to pass through an edge where the first side surface and the third side surface meet and an edge where the second side surface and the fourth side surface meet.

10. The ventilation apparatus according to claim 9, further comprising:

an intake side HEPA filter disposed adjacent to the second side surface; and an exhaust side HEPA filter disposed adjacent to the fourth side surface.

11. The ventilation apparatus according to claim 10, further comprising:

an intake side main damper module disposed at a flow passage connecting the outdoor air inlet and the first side surface; and an exhaust side main damper module disposed at a flow passage connecting the indoor air inlet and the third side surface.

12. The ventilation apparatus according to claim 11, wherein the case includes:

a bypass guide in which the intake and exhaust side bypass passages, the intake guide hole and the exhaust guide hole are formed, the bypass guide having a central partition wall that extends from an inner edge through which the dividing surface passes, to support a first corner of the enthalpy heat exchanger;

an intake side central wall supporting at least one side surface of the intake side main damper module and a second corner of the enthalpy heat exchanger;

an intake side main damper support wall supporting the other side of the intake side main damper module;

an enthalpy heat exchanger support wall supporting a third corner of the enthalpy heat exchanger;

an exhaust side central wall supporting at least one side surface of the exhaust side main damper module and a fourth corner of the enthalpy heat exchanger, and an exhaust side main damper support wall supporting the other side of the exhaust side main damper module.

13. The ventilation apparatus according to claim 12, wherein the bypass guide include:

a first portion in which the intake guide hole and the exhaust guide hole are formed at an outer edge, and having a square shape;

a pair of second portions each extending from both side ends of an inner edge of the first portion;

a central partition wall extending from a center of the inner edge of the first portion to support one corner of the enthalpy heat exchanger; and a separation wall protruding from a center of a lower surface of the first portion and extending from an outer edge of the first portion to the central partition wall, and wherein the first and second portions are spaced apart from an upper surface of the housing by the separation wall and the central partition wall, and the space where the intake fan is located and the space where the exhaust fan is located are partitioned.

14. The ventilation apparatus according to claim 13, wherein the intake side bypass passage extends from an end of one of the pair of second portions towards the exhaust guide hole, then is bent to extend towards the center of the first portion, wherein the exhaust side bypass passage extends from an end of the other of the pair of second portions towards the intake guide hole and then is bent to extend towards the center of the first portion, wherein the intake side bypass passage and the exhaust side bypass passage intersect each other at a point between the intake guide hole and the exhaust guide hole, and wherein an end of the intake side bypass passage is connected to the intake guide hole, and an end of the exhaust side bypass passage is connected to the exhaust guide hole.

15. The ventilation apparatus according to claim 7, wherein each of the intake side bypass filter unit or the exhaust side bypass filter unit includes:

a filter case in the form of a hexahedron; and a filter and a blocking block which are formed as one body and are detachably inserted into an inside of the filter case, wherein the filter case includes an upper surface, a lower surface, and four side surfaces, wherein a filter insertion hole is formed in one of the upper and lower surfaces, wherein an inlet and an outlet are formed on two opposing side surfaces among the four side surfaces, respectively, wherein the inlet is divided into an upper inlet and a lower inlet by a partition rib, wherein the filter is placed in either an upper space or a lower space of a surface passing through the partition rib, and wherein the blocking block is placed on the other of the upper space and the lower space of the surface passing through the partition rib.

16. The ventilation apparatus according to claim 7, wherein each of the intake side bypass filter unit or the exhaust side bypass filter unit includes:

a filter case in the form of a hexahedron; and a filter detachably inserted into the filter case, wherein the filter case includes an upper surface, a lower surface, and four side surfaces, wherein a filter insertion hole is formed on one of the upper and lower surfaces, wherein an inlet and an outlet are formed on two opposing side surfaces among the four side surfaces, respectively, and wherein the inlet is divided into an upper inlet and a lower inlet by a partition rib.

17. The ventilation apparatus according to claim 16, wherein the intake side bypass damper module includes:

an intake side upper bypass damper module disposed above the partition rib; and an intake side lower bypass damper module disposed below the partition rib, and wherein the exhaust side bypass damper module includes:

an exhaust side upper bypass damper module disposed above the partition rib; and an exhaust side lower bypass damper module disposed below the partition rib.

18. The ventilation apparatus according to claim 17, wherein each of the bypass damper modules includes:

first and second dampers placed in parallel to each other;

a drive motor that provides power to rotate the first and second dampers; and an opening/closing link that connects the driving motor and rotation shafts of the first and second dampers, respectively, to rotate the first and second dampers in directions symmetrical to each other, thereby opening or closing the inlet of a corresponding bypass passage.

19. The ventilation apparatus according to claim 18, wherein the opening/closing link includes:

a first link extending from the rotation shaft of the first damper;

a second link extending from the rotation shaft of the second damper;

a connection link connecting the first link and the second link;

a driving link extending from the rotation shaft of the second damper; and a transmission link connecting the drive motor and the driving link, wherein the driving link extends at a point axially spaced apart from the second link, and wherein the first link and the second link extend in opposite directions.

* * * * *